US007906266B2

(12) United States Patent
Magome et al.

(10) Patent No.: US 7,906,266 B2
(45) Date of Patent: Mar. 15, 2011

(54) MAGNETIC TONER

(75) Inventors: Michihisa Magome, Shizuoka-ken (JP); Eriko Yanase, Mishima (JP); Tatsuya Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 11/129,483

(22) Filed: May 16, 2005

(65) Prior Publication Data

US 2006/0188800 A1 Aug. 24, 2006

(30) Foreign Application Priority Data

Feb. 18, 2005 (JP) ..... 2005-042213

(51) Int. Cl.
*G03G 9/083* (2006.01)

(52) U.S. Cl. ..... 430/137.17; 430/106.1; 430/106.2; 430/137.1; 430/137.15

(58) Field of Classification Search ..... 430/106.1, 430/106.2, 137.15, 137.17
See application file for complete search history.

(56) References Cited

U.S. PATENT DOCUMENTS

| | | | | |
|---|---|---|---|---|
| 4,957,840 | A | 9/1990 | Sakashita et al. | 430/106.6 |
| 5,014,089 | A | 5/1991 | Sakashita et al. | 355/251 |
| 6,447,968 | B1 | 9/2002 | Ohno et al. | 430/106.2 |
| 6,465,144 | B1 * | 10/2002 | Hashimoto et al. | 430/106.1 |
| 6,653,035 | B2 | 11/2003 | Komoto et al. | 430/106.1 |
| 6,653,036 | B1 | 11/2003 | Tanikawa et al. | 430/106.2 |
| 2002/0009661 | A1 | 1/2002 | Hashimoto et al. | 430/106.1 |
| 2002/0055052 | A1 * | 5/2002 | Komoto et al. | 430/108.22 |
| 2002/0115011 | A1 * | 8/2002 | Komoto et al. | 430/125 |
| 2003/0064309 | A1 | 4/2003 | Komoto et al. | 430/106.1 |
| 2004/0081905 | A1 * | 4/2004 | Moribe et al. | 430/108.3 |

FOREIGN PATENT DOCUMENTS

| | | |
|---|---|---|
| EP | 1283450 A2 * | 2/2003 |
| JP | 01-112253 | 4/1989 |
| JP | 2000-272924 | 10/2000 |
| JP | 2001-235898 | 8/2001 |
| JP | 2002-323794 | 11/2002 |
| JP | 2003-043753 | 2/2003 |

* cited by examiner

*Primary Examiner* — Christopher RoDee
*Assistant Examiner* — Peter L Vajda
(74) *Attorney, Agent, or Firm* — Fitzpatrick, Cella, Harper & Scinto

(57) ABSTRACT

A magnetic toner is disclosed including magnetic toner particles containing at least a binder resin and a magnetic powder. The magnetic powder contains a specific amount of phosphorus elements, and a specific amount of silicon elements, based on the iron element, with the ratio of the phosphorous element to the silicon elements being in a specific range, and has a specific volume-average particle diameter, a specific saturation magnetization in a specific magnetic field, and a specific residual magnetization. The magnetic toner can realize high image density and reduce fog and spots around line images regardless of environmental variation, and is superior in durability, and besides, can achieve small toner consumption.

1 Claim, 1 Drawing Sheet

MAGNETIC TONER

BACKGROUND OF THE INVENTION

1. Field of the Invention

This invention relates to a magnetic toner used in recording processes such as electrophotography, electrostatic recording, magnetic recording and so forth.

2. Related Background Art

A number of methods are conventionally known as methods for electrophotography. In general, copies or prints are obtained by forming an electrostatic latent image on an electrostatically charged image bearing member (hereinafter also "photosensitive member") utilizing a photoconductive material and various means, subsequently developing the latent image by the use of a toner to form a toner image as a visible image, transferring the toner image to a recording medium such as paper as needed, and then fixing the toner image onto the recording medium by the action of heat and/or pressure. Apparatus for such image formation include copying machines, printers and so forth.

In recent years, these printers or copying machines have progressed from analogue machines to digital machines, and it is required to have a good reproducibility of latent images, be free of spots around line images and so forth, and have a high image quality. Also, at the same time, the main bodies of such printers or copying machines are increasingly miniaturized.

Here, taking note of, for example, printers, The use of printers is being divided into two forms. One is a large-sized printer adaptable to a network, where the printing is often performed on a large number of sheets at one time. The other is a personal printer for personal use in offices or in SOHO (small office home office). The personal printer is used in a low print percentage on account of its use form, and the printing is often performed on one or few sheets. Where printing is performed on few sheets at one time (hereinafter called "intermittent mode"), a high load is applied to the toner, as compared with the occasion of continuous printing on a large number of sheets, and the deterioration of the toner tends to be accelerated. This tendency is strong especially in an intermittent mode with a low print percentage in a high-temperature and high-humidity environment.

In particular, the personal printer is strongly desired to be miniaturized in respect of not only its main body but also its developing assembly itself. With such a trend, each of the component parts including a toner carrying member is also increasingly miniaturized. However, taking note of an image bearing member used along with a magnetic developer, the miniaturization of the toner carrying member is to reduce the diameter of the toner carrying member, and means that a magnet roller set in the toner carrying member also must be miniaturized. In this case, with a decrease in diameter of the magnet roller, the magnetic flux density inevitably decreases, tending to increase fog in a low-temperature and low-humidity environment. Moreover, it is essential for the toner to have a smaller particle diameter in order to achieve higher image quality, which is apt to increase fog.

To cope with such a problem, Japanese Patent Application Laid-open No. 2001-235898 proposes a spherical toner which makes use of a magnetic powder containing a phosphorus element. This toner has a superior resolution, and has a superior running (extensive operation) performance in a high-temperature and high-humidity environment. However, there is room for further improvement when used in the intermittent mode with a low print percentage in a high-temperature and high-humidity environment and a low-temperature and low-humidity environment.

In addition, the miniaturization of the developing assembly can be achieved not only by miniaturizing its component parts but also by reducing toner consumption. Accordingly, reduction in toner consumption is also strongly required.

In general, monochrome printers or copying machines are often used to reproduce letters or characters, where the toner consumption can be reduced by controlling what is called the toner amount laid on line (the toner amount used for developing line images). However, for example, in an attempt to form a line latent image of 200 μm in width and control the toner consumption, there has been such a problem that the line width actually obtained is fairly smaller than 200 μm, resulting in a lowering of the reproducibility of latent images.

In Japanese Patent Application Laid-Open No. H01-112253, there is the proposal that the toner consumption can be reduced by using a toner having a specific fine-powder content, true density and residual magnetization. However, such a toner tends to give a low solid-image density, and an attempt to increase the image density results in an increase in toner consumption and also in the line thickness.

That is, it has been very difficult to keep the image density high and reproduce lines faithfully to latent images while reducing the toner consumption.

Thus, in furtherance of miniaturizing the main body, toner is required to enjoy a low consumption and to provide good images in long-term use in various environments. In order to satisfy such requirements, room is still left for further improvement.

SUMMARY OF THE INVENTION

An object of the present invention is to provide a magnetic toner achieving high density, reducing fog regardless of environments and having high running performance, and besides, enjoying small toner consumption and reducing spots around line images.

The present invention is directed to a magnetic toner comprising magnetic toner particles containing at least a binder resin and a magnetic powder, wherein the magnetic powder contains a phosphorus element in an amount of from 0.05% by weight to 0.25% by weight based on an iron element and a silicon element in an amount of from 0.30% by weight to 0.80% by weight based on the iron element, where the proportion of the phosphorus element and the silicon element (P/Si) is from 0.15 to 0.35, has a volume-average particle diameter (Dv) of from 0.15 μm to 0.35 μm, has a saturation magnetization of from 67.0 $Am^2/kg$ to 75.0 $Am^2/kg$ (emu/g) in a magnetic field of 79.6 kA/m (1,000 oersteds), and has a residual magnetization of 4.5 $Am^2/kg$ (emu/g) or less.

DESCRIPTION OF THE PREFERRED EMBODIMENTS

According to the present invention, a toner can be provided which realizes high density, reduces fog without regard to environments, and has high running performance. Using the toner, images can be formed in small toner consumption and spots around line images can be reduced.

As a result of the present inventors' studies, it has been discovered that the magnetic properties of a magnetic powder used in the toner have a great influence on toner consumption, running (extensive-operation) performance in a high-temperature and high-humidity environment and on fog in a low-temperature and low-humidity environment, and the toner consumption can be reduced, the running performance in a high-temperature and high-humidity environment can be improved and the fog in a low-temperature and low-humidity environment can be remedied, by incorporating the magnetic powder with a phosphorus element and a silicon element in a specific proportion to control its magnetic properties so as to be of specific values. Thus, they have accomplished the present invention.

Figure 1:
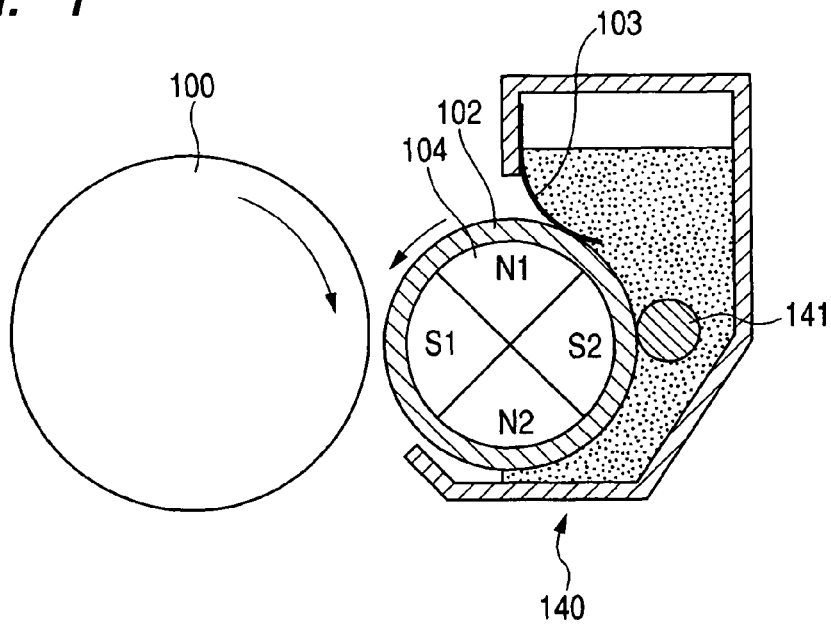
FIG. 1 is a sectional view showing an example of a cartridge used in Examples of the present invention.

First, they made detailed examination on toner deterioration. As a result, they have found that, in the intermittent mode with a low print percentage, the residual magnetization of the magnetic powder is greatly concerned in the toner deterioration. In the first place, an example of a developing assembly used in a printer is cross-sectionally shown in FIG. 1. In FIG. 1, reference numeral 100 denotes an electrostatically charged image bearing member; 102, a toner carrying member; 103, a toner control member; 104, a magnet roller; 140, a developing assembly; and 141, an agitation member. In the developing assembly 140, as shown in FIG. 1, a cylindrical toner carrying member 102 made of a non-magnetic metal such as aluminum or stainless steel is provided in proximity to the electrostatically charged image bearing member 100. A gap between the electrostatically charged image bearing member 100 and the toner carrying member 102 is maintained at an optional distance by the aid of a sleeve-to-photosensitive member gap retaining member (not shown). In the interior of the toner carrying member 102, the magnet roller 104 is stationarily provided so as to be concentric to the toner carrying member 102. However, the toner carrying member 102 is rotatable. The magnet roller 104 has a plurality of magnetic poles as shown in FIG. 1, where S1 is involved in development; N1, control of toner coat level; S2, take-in and transport of the toner; and N2, discharge of the toner.

Here, consider the residual magnetization of the magnetic powder. Where the residual magnetization is high, the toner discharged at the N2 pole is inferior in fluidity because of magnetic cohesion. Meanwhile, as being clear from FIG. 1, from the N2 pole to the S2 pole, the toner is in the state that it is easily packed for a physical reason as well because the toner is fed from a toner feed member (not shown) of a cartridge. Thus, the toner deteriorates because the pressure of packing is applied in addition to the above magnetic cohesion. In particular, in the intermittent mode with a low print percentage in a high-temperature and high-humidity environment, it follows that the toner is not consumed and besides the pressure of packing is continuously applied, so that, e.g., external additives may be buried in toner particles (toner base particles).

For this reason, also in order not to cause the magnetic cohesion, the magnetic powder must have a residual magnetization of 4.5 $Am^2/kg$ or less, and more preferably 4.0 $Am^2/kg$ or less.

However, where the magnetic powder has such a low residual magnetization, it may also have a low saturation magnetization. Hence, the fog may greatly occur if the magnetic powder is merely allowed to have a low residual magnetization. This tendency is strong, especially when a small-diameter toner carrying member is used, and the fog tends to greatly occur in a low-temperature and low-humidity environment.

For this reason, the toner should have a high saturation magnetization in order to keep the fog from occurring by the aid of magnetic binding force, and it is important for the toner to have a saturation magnetization of from 67.0 $Am^2/kg$ or more in an external magnetic field of 79.6 kA/m. On the other hand, it is very difficult for the magnetic powder to have a saturation magnetization of more than 75.0 $Am^2/kg$ while having a low residual magnetization. Thus, from the viewpoint of being free of a transition metal, it is essential for the magnetic powder to have a saturation magnetization of from 67.0 to 75.0 $Am^2/kg$, and more preferably from 68.0 to 75.0 $Am^2/kg$.

In addition, in the present invention, it is preferable for the magnetic powder to contain substantially no transition metal other than the iron element. What is meant by "substantially no transition metal" is that no transition metal other than the iron element is intentionally added when the magnetic powder is produced, and that transition metals other than the iron element, as impurities, are in a content of 1.0% or less, and more preferably 0.5%, in total.

Various studies have been made in order to obtain the magnetic powder having such magnetic properties. As a result, it has been found that the magnetic powder may be incorporated with the phosphorus element in an amount of from 0.05 to 0.25% by weight based on the iron element and the silicon element in an amount of from 0.30 to 0.80% by weight based on the iron element and may have the phosphorus element and the silicon element in a proportion (P/Si) of from 0.15 to 0.50, thereby establishing the above magnetic properties and effectively inhibiting the fog from occurring.

The reason therefor has not been clear, but the present inventors consider that the use of the specific amounts of the phosphorus element and silicon element in the specific proportion enables the phosphorus element and silicon element to be present in a special state in crystal lattices ($Fe_2O_3$) of the magnetic powder and causes the magnetic powder to have such magnetic properties.

In addition, if the phosphorus element is in an amount of less than 0.05% by weight, it is difficult for the magnetic powder to have a low residual magnetization, and if it is in an amount of more than 0.25% by weight, the magnetic powder has broad particle size distribution and it is difficult to control its particle diameter, which is undesirable. This is applied to the silicon element as well. If the silicon element is in an amount of less than 0.30% by weight, it is difficult for the magnetic powder to have a low residual magnetization, and if it is in an amount of more than 0.80% by weight, the magnetic powder has a broad particle size distribution and the dispersibility of the magnetic powder in toner particles may lower. Hence, this may greatly cause fog and is undesirable.

In addition, if the phosphorus element and the silicon element are in a proportion (P/Si) of less than 0.15, the magnetic powder can have a low residual magnetization, but it may have a low saturation magnetization, which is undesirable. On the other hand, if the phosphorus element and the silicon element are in a proportion (P/Si) of more than 0.50, the magnetic powder is so broad in particle size distribution as to have poor dispersibility in toner particles.

In addition, in the present invention, the particle size distribution of the magnetic powder may be expressed as a volume-average variation coefficient, which is preferably 30 or less. The smaller the value of the volume-average variation coefficient is, the sharper the particle size distribution is (i.e., the particle size distribution is concentrated in a narrower range). In the present invention, the volume-average variation coefficient is defined as one determined according to the following expression.

Volume-average variation coefficient=(standard deviation of particle size distribution of magnetic powder/volume-average particle diameter of magnetic powder)×100.

It is important for the magnetic powder to have a volume-average particle diameter (Dv) of from 0.15 μm to 0.35 μm. In general, the coloring power can be higher as the volume-average particle diameter (Dv) of the magnetic powder is smaller, but the magnetic powder tends to agglomerate to be inferior in uniform dispersibility in toner particles. Further, a magnetic powder having a small volume-average particle diameter (Dv) tends to have a high residual magnetization, and hence it is important for the magnetic powder to have Dv of 0.15 μm or more.

On the other hand, with a magnetic powder having a volume-average particle diameter (Dv) of 0.35 μm or more its residual magnetization can be lowered, but its saturation magnetization is lowered as well. Further, its uniform dispersion may be difficult to form in a suspension polymerization process which is a preferable process for producing the magnetic toner of the present invention. Hence, it is essential for the magnetic powder to have a volume-average particle diameter (Dv) of from 0.15 μm to 0.35 μm, and more preferably from 0.15 μm to 0.30 μm.

In addition, the volume-average particle diameter (Dv) may be measured with a transmission electron microscope (TEM). The magnetic powder may be observed on the transmission electron microscope to determine the volume-average particle diameter, or the volume-average particle diameter of the magnetic powder may be determined from a sectional photograph of toner particles.

Stated specifically, circle-equivalent diameters are determined which are equal to diameters of circles having the same areas as projected areas of 100 particles of the magnetic powder present in the visual field on a photograph taken at 10,000 to 40,000×, and the volume-average particle diameter is calculated on the basis on the circle-equivalent diameters.

As a specific method for determining the volume-average particle diameter of the magnetic powder from the sectional photograph of toner particles, the toner particles to be observed are thoroughly dispersed in epoxy resin, followed by curing for 2 days in an atmosphere with a temperature of 40° C. to obtain a cured product, which is then made into a thin-piece sample by means of a microtome. The sample obtained is photographed with a transmission electron microscope (TEM), and the volume-average particle diameter is determined by the method described above.

In addition, in Examples given below, the volume-average particle diameter (Dv) of the magnetic powder is measured with a transmission electron microscope, for 100 particles of the magnetic powder present in the visual field on a photograph taken at 40,000×, and then calculated.

The toner making use of such a magnetic powder enables the toner consumption to be reduced. Various studies have been made on the toner consumption, and as a result, it has been found that the toner consumption correlates with the amount of toner laid on line areas, and the amount of toner laid on line areas (i.e., the toner amount laid-on line) may be lessened, whereby the toner consumption can be reduced.

Here, referring to magnetic one-component development, it has been fairly difficult to control the toner amount laid-on line while keeping the line width constant. The reason therefore is that in the developing zone, the toner behaves not as particles but as "ears" formed of a plurality of particles, and the toner is involved in development in a quantity beyond what is necessary for filling out latent images. Also, this tendency is remarkable in jumping development in which what is called the edge effect comes about (which is a phenomenon in which electric charges concentrate at edge portions of lines to cause an increase in the toner amount used for development at the edge portions), where it has been very difficult to control the toner amount laid-on line while keeping the line width constant.

However, the use of the magnetic toner of the present invention, i.e., the toner having the magnetic powder with a high saturation magnetization and a low residual magnetization enables uniform ears to be formed on the toner carrying member. Such uniform ears fly from the toner carrying member to the image bearing member at the developing zone upon receipt of development bias. Since the magnetic toner of the present invention has a low residual magnetization as stated above, the ears formed of the toner are disrupted at the developing zone and the toner behaves as individual particles one by one. Hence, it does not come about that the toner is not supplied more than necessary for development, and hence the toner amount laid-on line can be reduced. Also, because of such a small toner amount laid on line and a low residual magnetization, the spots around line images can be inhibited from occurring.

As described above, the volume-average particle diameter and magnetic properties of the magnetic powder and the amount and proportion of the elements contained therein are suitably balanced, thereby achieving both the running performance in a high-temperature and high-humidity environment and the prevention of fog in a low-temperature and low-humidity environment. Further, the toner amount laid on line can be controlled even in the same line width, and the toner consumption can be reduced.

In addition, in the present invention, the intensity of magnetization of the magnetic toner is measured with a vibration type magnetic-force meter VSM P-1-10 (manufactured by Toei Industry, Co., Ltd.) under application of an external magnetic field of 79.6 kA/m at room temperature of 25° C.

The magnetic powder used in the present invention may also preferably have a 50% volume diameter of from 0.5 μm to 1.5 μm, and more preferably from 0.5 μm to 1.1 μm, in styrene/n-butyl acrylate, and have an SD value of 0.4 μm or less which is represented by the following expression (1):

$$SD=(d84\%-d16\%)/2 \quad (1)$$

wherein d16% represents the particle diameter at which the cumulative value comes to be 16% by volume in volume-based particle size distribution, and d84% represents the particle diameter at which the cumulative value comes to be 84% by volume.

In the suspension polymerization process which is a preferable process for producing the magnetic toner of the present invention, the magnetic powder must be dispersed in polymerizable monomers including styrene. Hence, in order to improve the uniform dispersibility of the magnetic powder in toner particles, it is important for the magnetic powder to have a fine particle size at the time of dispersing it in the polymerizable monomers in order to concentrate the particle size distribution in a narrow range. As a result of studies made from this standpoint, it has been found that as long as the magnetic powder have a 50% volume diameter of 1.5 μm or less (more preferably 1.1 μm or less) in styrene/n-butyl acrylate, the magnetic powder is substantially uniformly dispersed in toner particles, and the distribution of the magnetic powder between the toner particles can be almost uniform. Further, where the SD value represented by the expression (1)

is 0.4 μm or less, i.e., the particle size distribution in the styrene/n-butyl acrylate is sharp, the effect of improving the dispersibility of the magnetic powder in toner particles can be very great. Thus, such an SD value is more preferable.

On the other hand, in order the magnetic powder to have a 50% volume diameter of less than 0.5 μm, it must be dispersed for a very long time and also strong shear must be applied, resulting in very poor productivity. Thus, the magnetic powder in the present invention may preferably have a 50% volume diameter of from 0.5 μm to 1.5 μm (and more preferably from 0.5 μm to 1.1 μm) in styrene/n-butyl acrylate, and have an SD value of 0.4 μm or less.

In addition, the 50% volume diameter in styrene/n-butyl acrylate and the SD value of the magnetic powder are measured in the following way.

29.6 g of styrene and 10.4 g of n-butyl acrylate are put into 150 ml of a glass bottle, which is attached to an equipment DISPERMAT (manufactured by VMA GETZMANN GMBH). Next, a disk of 30 mm in diameter is attached to the equipment DISPERMAT, and 36 g of the magnetic powder is introduced thereinto over a period of 1 minute while being stirred at 600 ppm. Thereafter, the number of revolutions is raised to 4,000 rpm, which was retained for 30 minutes. Immediately after the dispersion slurry thus obtained has been stirred, measurement is made with MICROTRACK (manufactured by Nikkiso Co., Ltd.) to determine the 50% volume diameter (μm) and the SD value (μm).

The magnetic powder used in the magnetic toner of the present invention may be produced by, e.g., the following method.

To an aqueous ferrous salt solution, an alkali such as sodium hydroxide is added in an equivalent weight or more based on the iron component, a phosphorus compound such as sodium silicate is so added that the phosphorus element may be in an amount of from 0.05 to 0.25% by weight based on the iron element, and a silicon compound such as sodium silicate is so added that the silicon element may be in an amount of from 0.30 to 0.80% by weight based on the iron element to prepare an aqueous solution containing ferrous hydroxide. Into the aqueous solution thus prepared, air is blown while pH of the solution is maintained at 7 or above, and the ferrous hydroxide is subjected to oxidation reaction while the aqueous solution is heated at 70° C. or above to form seed crystals serving as cores of magnetic ion oxide particles.

Next, to a slurry-like liquid containing the seed crystals, an aqueous solution containing ferrous sulfate in about one equivalent weight on the basis of the amount of the alkali previously added is added. The reaction of the ferrous hydroxide is continued while pH of the liquid is maintained at 5 to 10 and air is blown, causing magnetic fine iron oxide particles to grow around the seed crystals as cores. At this point, pH, reaction temperature and stirring conditions may be appropriately selected to control the particle shape of the magnetic powder. After the oxidation reaction has been completed. the particle surfaces of the magnetic powder are subjected to hydrophobic treatment. Where the hydrophobic treatment is carried out by a dry process, the magnetic material obtained after washing, filtration and drying is subjected to hydrophobic treatment using a silane compound. Where the hydrophobic treatment is carried out by a wet process, the magnetic powder dried after the oxidation reaction is dispersed again. Alternatively, the iron oxide powder obtained after the oxidation reaction followed by washing and filtration, may be dispersed again in a different aqueous medium without being dried, and pH of the dispersion may be adjusted to the acid side, where the silane compound may be added with thorough stirring, and the temperature may be raised after hydrolysis or the pH may be adjusted to the alkaline side to carry out the hydrophobic treatment. However, in order to obtain the magnetic powder having a 50% volume diameter of 1.5 μm or less in styrene/n-butyl acrylate and an SD value of 0.4 μm or less, which are preferred requirements of the present invention, it is preferable that the iron oxide powder obtained after the oxidation reaction followed by washing and filtration, is formed into a slurry without being dried and then the hydrophobic treatment is carried out.

To carry out treatment by a wet process, i.e., with a silane compound in an aqueous medium for the hydrophobic treatment of the magnetic powder, the magnetic powder is sufficiently dispersed in the aqueous medium so as to become primary particles, and then stirred with a stirring blade or the like so as not to settle or agglomerate. Next, the silane compound is introduced in any desired amount, and the hydrophobic treatment is carried out while hydrolyzing the silane compound. Here, it is more preferable to carry out the hydrophobic treatment while sufficiently carrying out dispersion so as not to cause agglomeration, with stirring and using an apparatus such as a pin mill or a line mill.

Here, the aqueous medium is meant to be a medium composed chiefly of water. Stated specifically, it may include water itself, water to which a surface-active agent has been added in a small quantity, water to which a pH adjuster has been added, and water to which an organic solvent has been added. As for the surface-active agent, nonionic surface-active agents such as polyvinyl alcohol are preferred. The surface-active agent may be added in an amount of from 0.1 to 5.0% by weight based on water. The pH adjuster may include inorganic acids such as hydrochloric acid. The organic solvent may include alcohols.

The magnetic powder thus treated is further subjected to washing, filtration and drying, where drying conditions and disintegration conditions should be so determined that the magnetic powder has the 50% volume diameter in styrene/n-butyl acrylate and the SD value as described above. Besides the use of the silane compound for the hydrophobic treatment of the magnetic powder, a titanium compound also may be used.

In the step of drying, if drying temperature is low, the silane compound may be liberated from the magnetic powder particle surfaces after the hydrophobic treatment has been carried out because the binding strength between the silane compound and the magnetic powder particle surfaces is low, so that the magnetic powder particle surfaces may become exposed. Hence, a large 50% volume diameter in styrene/n-butyl acrylate and a large SD value may result.

On the other hand, if the drying temperature is high, the magnetic powder may agglomerate during the drying, resulting in a large 50% volume diameter in styrene/n-butyl acrylate.

The silane compound used in the present invention may preferably be one represented by the general formula (I).

$$R_mSiY_n \quad (I)$$

wherein R represents an alkoxyl group; m represents an integer of 1 to 3; Y represents a hydrocarbon group such as an alkyl group, a vinyl group, a glycidoxy group or a methacrylic group; and n represents an integer of 1 to 3; provided that m+n=4.

The silane coupling agents represented by the general formula (I) may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, from the viewpoint of achievement of high hydrophobicity, an alkyltrialkoxysilane compound represented by the following general formula (II) may preferably be used.

$$C_pH_{2p+1}—Si—(OC_qH_{2q+1})_3 \quad (II)$$

wherein p represents an integer of 2 to 20, and q represents an integer of 1 to 3.

In the above formula, if p is smaller than 2, it is difficult to provide a sufficient hydrophobicity. If p is larger than 20, though hydrophobicity is sufficient, the magnetic powder particles may greatly coalesce one another, which is undesirable.

In addition, if q is larger than 3, the silane compound may be low in reactivity to make it hard for the magnetic powder to be made sufficiently hydrophobic. Accordingly, it is good to use an alkyltrialkoxysilane compound in which p in the formula represents an integer of 2 to 20 (more preferably an integer of 3 to 15) and q represents an integer of 1 to 3 (more preferably an integer of 1 or 2).

In the case where the above silane compounds are used, the treatment may be carried out using each of them alone or in combination. When used in combination, the treatment may be carried out using the respective coupling agents separately, or the treatment may be carried out using them simultaneously.

The magnetic powder in the present invention may be coated with the silane compound of from 0.9 to 3.0 parts by weight, and more preferably from 0.9 to 2.5 parts by weight, based on 100 parts by weight of the magnetic powder. Further, it is important to control the amount of the treating agent silane compound in accordance with the surface area of the magnetic powder, the reactivity of the silane compound, and so forth.

In the present invention, the silane compound may preferably be in a liberation percentage of from 3% to 30%, and more preferably from 3% to 20%, which is found from the following expression (2):

Liberation percentage=(1−(the amount of the silane compound included in the magnetic powder after being dispersed in toluene for 60 minutes)/(the coverage of the silane compound the magnetic powder has))×100 (2).

The liberation percentage indicates the proportion of the silane compound liberated from the magnetic powder. It means that as this value is larger, the magnetic powder has been hydrophobic-treated with a more excess amount of the silane compound.

According to the present inventors' studies, the amount of the silane compound included in the magnetic powder after being dispersed in toluene depends substantially on the type and specific surface area of the magnetic powder (hereinafter, the amount of the silane compound is regarded as the necessary and minimum treatment level). Thus, if the magnetic powder is treated with the silane compound in an amount smaller than the necessary and minimum treatment level, it may have low hydrophobicity and poor dispersibility.

However, it has been turned out that since it is very difficult for all the magnetic powder to be completely subjected to hydrophobic treatment, it is necessary to carry out the treatment in an amount a little larger than the necessary and minimum silane compound treatment level, and as long as the silane compound is in a liberation percentage of 3% or more, neither lowering in the degree of hydrophobicity nor faulty dispersion may not be caused.

On the other hand, if the silane compound is in a liberation percentage of more than 30%, the magnetic powder tends to be a little agglomerative. Further, such a magnetic powder is apt to lower a charge quantity or the like of the toner, undesirably.

In addition, a specific method for measuring the liberation percentage is as follows:

1 g of a magnetic powder fired at 500° C. is heated and dissolved in 10 ml of concentrated hydrochloric acid. Thereafter, pure water is added to bring the total amount into 100 ml (a mother liquor). A portion of 20 ml is taken from the mother liquor, and pure water is added to bring the total amount into 100 ml to prepare a solution (for measurement). A portion of 20 ml is further taken from the mother liquor, and a silica reference liquid for atomic spectrophotometry is added in a stated amount. Then, pure water is added to bring the total amount into 100 ml to prepare a solution (for standardization).

Next, the Si level (mg) in the measuring solution is determined by the reference addition method, using an ICP (inductively coupled plasma) emission spectroscopic analyzer (trade name: Vista-PRO; manufactured by Seiko Instruments Inc.), and the Si level (%) of the magnetic powder is calculated.

Here, an Si level included in the magnetic powder hydrophobic-treated with the silane compound is represented by Si-1, and an Si level included in the magnetic powder hydrophobic-untreated with the silane compound is represented by Si-2.

Meanwhile, 20.0 g of the magnetic powder hydrophobic-treated with the silane compound and 13.0 g of toluene were put into a 50 ml screwed pipe bottle, and shaked, followed by irradiation with ultrasonic waves for 60 minutes by means of an ultrasonic dispersion machine. Thereafter, this is centrifuged for 15 minutes at 2,000 rpm, using a centrifugal separator, followed by removal of the supernatant liquid to obtain precipitate. The precipitate obtained is dried at 90° C. for 1 hour, and thereafter an Si level (Si-3) in the magnetic powder is measured by the above method.

Here, the value found by subtracting Si-2 from Si-1 is the level of the silane compound included in the magnetic powder. In the present invention, this is regarded as the coating amount of the silane compound. Also, the value found by subtracting Si-3 from Si-2 is the level of the silane compound included in the magnetic powder after being dispersed in toluene for 60 minutes.

Using these, the liberation percentage is found according to the following expression (2):

Liberation percentage=(1−(level of silane compound included in magnetic powder after dispersed in toluene for 60 minutes)/(coating amount of silane compound included in magnetic powder))×100 (2).

The magnetic powder used in the magnetic toner of the present invention is one composed chiefly of iron oxide such as triiron tetraoxide or γ-iron oxide, which may contain, besides the phosphorus and silicon elements, any of elements such as cobalt, nickel, copper, magnesium, manganese and aluminum. Any of these may be used alone or in a combination of two or more types.

As for the particle shape of the magnetic powder, it may be polyhedral (e.g., octahedral or hexahedral), spherical, acicular or flaky. The magnetic powder in the present invention is preferably spherical in view of its magnetic properties.

In the present invention, in addition to the magnetic powder, other colorants may also be used in combination. Such colorants usable in combination may include magnetic or non-magnetic inorganic compounds and known dyes and pigments. Stated specifically, it may include, e.g., ferromagnetic metal particles of cobalt, nickel or the like, or particles of alloys of any of these metals to which chromium, manganese, copper, zinc, aluminum, a rare earth element or the like has been added; and particles of hematite or the like, titanium black, nigrosine dyes or pigments, carbon black, and phthalocyanines. These may be used after particle surface treatment.

The magnetic powder used in the magnetic toner of the present invention, the magnetic powder may be preferably used in an amount of from 20 to 150 parts by weight based on 100 parts by weight of the binder resin. It may be more preferably used in an amount of from 30 to 140 parts by weight. If it is less than 20 parts by weight, the magnetic toner may be inferior in tinting power while having good fixing performance, and it is difficult to keep fog from occurring. On the other hand, if it is more than 150 parts by weight, the magnetic toner may be inferior in fixing performance and also be so strongly held on the toner-carrying member by magnetic force as to have a low developing performance, which is undesirable.

In addition, the content of the magnetic powder in the toner may be measured with a thermal analyzer TGA7 manufactured by Perkin-Elmer Corporation. As for a measuring method, the toner is heated at a heating rate of 25° C./minute from normal temperature to 900° C. in an atmosphere of nitrogen. The weight loss weight percent in the course of from 100° C. to 750° C. is regarded as binder resin weight, and residual weight is approximately regarded as magnetic powder weight.

In order to faithfully develop minuter latent image dots to enhance image quality, the magnetic toner of the present invention may preferably have a weight-average particle diameter of from 3 μm to 10 μm, and more preferably from 4 μm to 9 μm. If it has a weight-average particle diameter of less than 3 μm, it may be inferior in low fluidity and agitatability required for powder, and individual toner particles are difficult to uniformly charge. The smaller the toner particle diameter, the more easily the toner bring about charge-up, resulting in low developing performance. Further, such a toner may cause fog seriously in a low-temperature and low-humidity environment, which is undesirable.

On the other hand, if it has a weight-average particle diameter of more than 10 μm, the fog may be inhibited from occurring, it is difficult to enhance image quality as stated above, and also the toner amount laid on line areas may increase, resulting in large toner consumption, which is undesirable.

The weight-average particle diameter and particle size distribution of the magnetic toner may be measured by various methods making use of Coulter Counter Model TA-II or Coulter Multisizer (manufactured by Coulter Electronics, Inc.). In the present invention, Coulter Multisizer (manufactured by Coulter Electronics, Inc.) is used. An interface (manufactured by Nikkaki Bios Co.) that outputs number distribution and volume distribution and a personal computer PC9801 (manufactured by NEC.) are connected. As an electrolytic solution, a 1% NaCl aqueous solution is prepared using first-grade sodium chloride. For example, ISOTON R-II (available from Coulter Scientific Japan Co.) may be used.

As for a measuring method, 0.1 to 5 ml of a surface active agent (preferably alkylbenzene sulfonate) is added as a dispersant in 100 to 150 ml of the above aqueous electrolytic solution, and further 2 to 20 mg of a sample to be measured is added. The electrolytic solution in which the sample has been suspended is subjected to dispersion treatment for about 1 minute to about 3 minutes in an ultrasonic dispersion machine. The number distribution is calculated by measuring the number of toner particles of 2 μm or more in particle diameter by means of the above Coulter Multisizer, using an aperture of 100 μm. Then the number-based, length-average particle diameter determined from number distribution, i.e., number-average particle diameter, and weight-average particle diameter are determined. Also in Examples given below, they are determined in the same way.

The magnetic toner of the present invention may preferably have an average circularity of from 0.960 or more. Inasmuch as the magnetic toner has an average circularity of 0.960 or more, the toner has a closely spherical particle shape and is good in fluidity, and hence it can be readily triboelectrically charged to have uniform charge quantity distribution. Also, the toner having a high average circularity can be formed into fine and uniform ears on the toner carrying member. This is preferable because the toner consumption can be more reduced on account of the effect brought about in cooperation with the feature of the toner having a low residual magnetization.

The magnetic toner of the present invention may also have a mode circularity of 0.99 or more in circularity distribution. This means that most toner particles have a shape close to a true sphere. This is preferable because the above operation is more remarkable.

The average circularity referred to in the present invention is used as a simple method for expressing the shape of particles quantitatively. In the present invention, the shape of particles is measured with a flow type particle image analyzer FPIA-1000, manufactured by Sysmex Corporation, and circularity (Ci) of each particle measured on a group of particles having a circle-equivalent diameter of 3 μm or more is individually determined according to the following expression (4). As shown in the following expression (5), the value found when the sum total of circularities of all particles measured is divided by the number (m) of all particles is defined as the average circularity (C).

$$\text{Circularity } (Ci) = \frac{\text{(circumference of circle whose area is equal to projected particle area)}}{\text{(perimeter of projected particle image)}}. \quad (4)$$

$$\text{Average circularity } (C) = \sum_{i=1}^{m} Ci/m. \quad (5)$$

The mode circularity refers to a peak circularity at which the frequency value comes to be the maximum in the circularity frequency distribution obtained in such a way that circularities of 0.40 to 1.00 are divided into 61 ranges at intervals of 0.01 and each of the particle circularities as measured is allotted to each of the divided ranges in accordance with the corresponding circularity.

The measuring device "FPIA-1000" used in the present invention employs a calculation method in which, in calculating the circularity of each particle and thereafter calculating the average circularity and mode circularity, particles are divided into classes in which the circularities of 0.40 to 1.00 are divided into 61 ranges in accordance with the corresponding circularities, and the average circularity and mode circularity are calculated using the center values and frequencies of division points. However, between the values of the average circularity and mode circularity calculated by this calculation method and the values of the average circularity and mode circularity calculated by the above calculation equation which uses the circularity of each particle directly, there is only a very small difference, which is at a substantially negligible level. Accordingly, in the present invention, such a calculation method in which the concept of the calculation equation which uses the circularity of each particle directly is utilized and is partly modified may be used, on account of handling data, e.g., shortening the calculation time and simplifying the operational equation for calculation.

The measurement is made in the procedure as shown below.

In 10 ml of water in which about 0.1 mg of a surface-active agent has been dissolved, about 5 mg of the magnetic toner is dispersed to prepare dispersion. Then, the dispersion is exposed to ultrasonic waves (20 kHz, 50 W) and adjusted to have a concentration of 5,000 to 20,000 particles/μl, where the measurement is made using the above analyzer to determine the average circularity and mode circularity of the group of particles having a circle-equivalent diameter of 3 μm or larger.

The average circularity referred to in the present invention is an index showing the degree of surface unevenness of magnetic toner particles. It is indicated as 1.000 when the particles are perfectly spherical. The more complicate the surface shape of magnetic toner particles is, the smaller the value of average circularity is.

In addition, in this measurement, the reason why the circularity is measured only on the group of particles having a circle-equivalent diameter of 3 μm or larger is that a group of particles of external additives existing independently of toner particles are included in a large number in a group of particles having a circle-equivalent diameter smaller than 3 μm, which may affect the measurement to make it impossible to accurately estimate the circularity on the group of toner particles.

The magnetic toner of the present invention may preferably be mixed with a charge control agent in order to improve charging performance. As the charge control agent, any known charge control agent may be used. In particular, charge control agents that have a high charging speed and can stably maintain a constant charge quantity are preferred. Further, in the case where the toner particles are directly produced by polymerization, it is particularly preferable to use charge control agents low in polymerization inhibitory action and substantially free of material soluble into the aqueous dispersion medium. Specific compounds may include, as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymers having a sulfonic acid or carboxylic acid group in their side chains; and boron compounds, urea compounds, silicon compounds, and carixarene; and as positive charge control agents, quaternary ammonium salts, polymers having such a quaternary ammonium salt in their side chains, guanidine compounds, Nigrosine compounds and imidazole compounds.

Of these, it is more preferable from the viewpoint of performing uniform charging, to use a polymer having a sulfonic acid group in its side chain.

In addition, it is more preferable that in the magnetic toner of the present invention, the ratio of an abundance A (atomic %) of carbon elements present at magnetic toner particle surfaces to an abundance B (atomic %) of sulfur elements present at the same surfaces, E/A, as measured by X-ray photoelectric spectrophotometry, is $3\times10^{-4} \leqq E/A \leqq 50\times10^{-4}$.

Where the polymer having a sulfonic acid group is used in a suspension polymerization process, which can favorably produce the magnetic toner of the present invention, the polymer having a sulfonic acid group comes to be localized at the magnetic toner particle surfaces on account of its hydrophilicity and polarity. Hence, the value of E/A is controlled as shown above, thereby enabling the magnetic toner to quickly start charging and to have a sufficient charge quantity. In virtue of an effect brought about cooperatively by the magnetic properties of the magnetic powder and the uniform dispersion thereof, uniform charging performance can be achieved with ease, the spots around line images can vastly be remedied, and fog hardly occurs even in long-term service.

On the other hand, a toner in which the value of E/A is lower than $3\times10^{-4}$ is undesirable because it is apt ot become short in charge quantity. A toner in which the value of E/A is higher than $50\times10^{-4}$ can quickly start charging, but is undesirable because the toner has excessive charge quantity so as to tend to cause what is called charge-up and has broad charge quantity distribution.

The ratio of the presence level (or abundance) A (atomic %) of a carbon element present at magnetic toner particle surfaces to the presence level (or abundance) B (atomic %) of a sulfur element present at the same surfaces, E/A, in the present invention is measured by analyzing surface composition by ESCA (X-ray photoelectric spectrophotometry).

In the present invention, the instrument and measuring conditions of the ESCA are as follows: Instrument used: 1600S type X-ray photoelectric spectrophotometer, manufactured by PHI Inc. (Physical Electronic Industries, Inc.).

Measuring Conditions:

X-ray source, MgKα (400 W).

Spectral range, 800 μmφ.

In the present invention, the surface atom concentration (atomic %) is calculated from the peak intensity of each element as measured, using relative sensitivity factors provided by PHI Inc.

The toner is used as a sample to be measured. Where external additives are added to the toner, toner particles are washed with a solvent incapable of dissolving the toner particles, such as isopropanol, to remove the external additives, and thereafterer the measurement is made.

A monomer used for producing the polymer having a sulfonic acid group may include styrene sulfonic acid, 2-acrylamido-2-methylpropanesulfonic acid, 2-methacrylamido-2-methylpropanesulfonic acid, vinylsulfonic acid and methacrylsulfonic acid. The polymer having a sulfonic acid group, used in the present invention may be a homopolymer of any of the above monomers, or a copolymer of any of the above monomers with other monomers.

In particular, it may be a copolymer of a sulfonic acid group-containing (meth)acrylic amide type monomer and styrene and/or styrene-(meth)acrylic acid, which is preferable because the toner can have very good charging performance. In this case, the sulfonic acid group-containing (meth) acrylic amide type monomer may preferably be in a content of from 1.0 to 10.0 parts by weight based on 100 parts by weight of the copolymer. It may be added in an amount so controlled that the value of E/A is from $3\times10^{-4}$ to $50\times10^{-4}$.

The monomer which forms the polymer having a sulfonic acid group includes vinyl type polymerizable monomers. Monofunctional polymerizable monomers and polyfunctional polymerizable monomers may be used.

The monofunctional polymerizable monomers may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxydiethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxydiethoxy)phenyl]propane, 2,2'-bis[4-(methacryloxypolyethoxy)phenyl]propane, trimethyrolpropane trimethacrylate, tetramethyrolmethane tetramethacrylate, divinyl benzene, divinyl naphthalene, and divinyl ether.

The polymer having a sulfonic acid group may be produced by a process including bulk polymerization, solution polymerization, emulsion polymerization, suspension polymerization and ionic polymerization. In view of operability and so forth, solution polymerization is preferred.

The polymer having a sulfonic acid group has the following structure.

$$X(SO_3^-)_n mY^{k+}$$

wherein X represents a polymer moiety derived from the above polymerizable monomer, $Y^+$ represents a counter ion, k is the valence number of the counter ion, m and n are each independently an integer, where n is k×m. The counter ion may be a hydrogen ion, a sodium ion, a potassium ion, a calcium ion or an ammonium ion.

The polymer having a sulfonic acid group may preferably have a weight-average molecular weight (Mw) of from 2,000 to 100,000. If it has a weight-average molecular weight (Mw) of less than 2,000, the toner may have poor fluidity, resulting in low transfer performance. If it has a weight-average molecular weight (Mw) of more than 100,000, it takes time to dissolve the polymer in monomers and it is difficult for sulfur elements to be uniformly present over the toner particle surfaces.

The polymer having a sulfonic acid group may preferably have a glass transition point (Tg) of from 50° C. to 100° C. If it has a glass transition point of less than 50° C., the toner may be inferior in fluidity and storage stability and deteriorate in long-term service. On the other hand, if it has a glass transition point of more than 100° C., the toner may have poor fixing performance.

Methods for incorporating toner particles (toner base particles) with the charge control agent commonly include a method of internally adding the charge control agnet to the toner particles and, in the case where suspension polymerization is carried out, a method in which the charge control agent is added to a polymerizable monomer composition before granulation. A polymerizable monomer in which the charge control agent has been dissolved or suspended may be added in the midst of effecting polymerization while forming oil droplets in water, or after the polymerization, to carry out seed polymerization so as to cover toner particle surfaces uniformly. Where an organometallic compound is used as the charge control agent, the compound may be added to the toner particles and mixed and agitated under application of shear to incorporate the charge control agent into toner particles.

The quantity of this charge control agent depends on the type of the binder resin, the presence of any other additives, and a method of producing the toner, inclusive of a dispersing method, and cannot be absolutely specified. When added internally, the charge control agent may preferably be used in an amount ranging from 0.1 to 10 parts by weight, and more preferably from 0.1 to 5 parts by weight, based on 100 parts by weight of the binder resin. When added externally, it may preferably be added in an amount of from 0.005 to 1.0 part by weight, and more preferably from 0.01 to 0.3 part by weight, based on 100 parts by weight of the toner.

The magnetic toner of the present invention may preferably contain a release agent in order to improve fixing performance, which may preferably be contained in an amount of from 1 to 30% by weight based on the weight of the binder resin. It may more preferably be contained in an amount of from 3 to 25% by weight. If the release agent is in a content of less than 1% by weight, the effect brought about by adding the release agent may be insufficient and also the effect of controlling offset may be insufficient. On the other hand, if it is in a content of more than 30% by weight, the magnetic toner may be inferior in long-term storage stability, and the dispersibility of toner materials such as the release agent and the magnetic powder may deteriorates to lower fluidity of the magnetic toner and image characteristics. In addition, release agent components may ooze out, resulting in inferior running performance in a high-temperature and high-humidity environment. Since the release agent (wax) is enclosed in a large quantity, the shape of toner particles tends to be distorted.

In general, toner images transferred onto a recording medium are fixed onto the recording medium by the aid of energy such as heat and pressure, thus a semipermanent image is obtained. Here, heat-roll fixing is commonly in wide use. As stated previously, highly minute images can be obtained using a magnetic toner having a weight-average particle diameter of 10 μm or smaller. However, toner particles having such a small particle diameter may enter the gaps of fibers of paper when a recording medium such as paper is used, so that heat cannot be sufficiently received from a heat-fixing roller to tend to cause low-temperature offset. However, in the magnetic toner according to the present invention, the release agent is incorporated in an appropriate quantity, whereby both high image quality and fixing performance can simultaneously be achieved.

The release agent usable in the magnetic toner according to the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. The following compounds are also usable: higher aliphatic alcohols, fatty acids such as stearic acid and palmitic acid, or compounds thereof, acid amide waxes, ester waxes, ketones, hardened castor oil and derivatives thereof, vegetable waxes, and animal waxes.

The release agent may have a peak top temperature of an endothermic peak within the temperature range of from . . . ° C. to . . . ° C. Such a peak top temperature of the endothermic peak of the release agent is measured according to ASTM D 3417-9.

The magnetic toner of the present invention may be produced by any known method. When produced by pulverization, for example, components necessary as the magnetic toner, such as the binder resin, the magnetic powder, the release agent, the charge control agent and optionally the colorant, and other additives are thoroughly mixed by mean of a mixer such as Henschel mixer or a ball mill. Thereafter, the resulting mixture is melt-kneaded by means of a heat kneading machine such as a heat roll, a kneader or an extruder to melt resins one another and dissolve or disperse other magnetic toner materials such as the magnetic powder in that resins. The kneaded product is cooled to solidify, followed by pulverization, classification and optionally surface treatment to produce toner particles. Either of the classification and the surface treatment may be carried out first. In the step of classification, a multi-division classifier may preferably be used in view of the improvement of production efficiency.

The pulverization step may be carried out by any method making use of a known pulverizer such as a mechanical impact type or a jet type. In order to obtain the magnetic toner having the preferable average circularity (0.960 or more) in the present invention, it is preferable to further apply heat to effect pulverization or to subsidiarily add mechanical impact. Also usable are, e.g., a hot-water bath method in which toner particles finely pulverized (and optionally classified) are dispersed in hot water, and a method in which the toner particles are passed through a hot-air stream.

As means for applying mechanical impact force, the following methods are cited: e.g., a method making use of a mechanical impact type pulverizer such as a kryptron system, manufactured by Kawasaki Heavy Industries, Ltd., or a turbo mill, manufactured by Turbo Kogyo Co., Ltd., and a method in which toner particles are pressed against the inner wall of a casing by centrifugal force using a high-speed rotating blade to apply mechanical impact by force such as compression force or frictional force, as exemplified by apparatus such as a mechanofusion system, manufactured by Hosokawa Micron Corporation, or Hybridization system, manufactured by Nara Machinery Co., Ltd.

When such a mechanical impact method is used, thermomechanical impact in which heat is applied at a temperature around glass transition temperature Tg of the magnetic toner particles (Tg±10° C.) is preferred from the viewpoint of prevention of agglomeration and productivity. More preferably, heat may be applied at a temperature within ±5° C. of the glass transition temperature Tg of the toner, as being effective in the improvement of transfer efficiency.

As the binder resin used when the magnetic toner according to the present invention is produced by pulverization, the following may be cited: homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins. Any of these may be used alone or in combination of two or more types. Of these, styrene copolymers and polyester resins are particularly preferred in view of developing performance, fixing performance and so forth.

The magnetic toner may preferably have a glass transition temperature (Tg) of from 30° C. to 80° C., and more preferably from 35° C. to 70° C. If it has a Tg lower than 30° C., the toner may have low storage stability. If it has a Tg higher than 80° C., it may have poor fixing performance. The glass transition temperature of the toner may be measured with a differential scanning calorimeter. The measurement is made according to ASTM D 3418-99. In addition, in the measurement, the temperature of a sample is raised once to erase a previous history and then rapidly dropped. The temperature is raised again at a heating rate of 10° C./min within a temperature range of from 30° C. to 200° C., and the DSC curve thus obtained is used.

The magnetic toner of the present invention may be produced by pulverization as described previously. However, the toner particles obtained by pulverization are normally amorphous or shapeless, and hence mechanical or thermal or some special treatment must be applied in order to attain the physical properties, the average circularity of 0.960 or more, preferably used in the present invention, which is inferior in productivity. Accordingly, the magnetic toner of the present invention may preferably be a toner obtained by a method of producing toner particles in an aqueous medium, as in dispersion polymerization, association agglomeration, suspension polymerization or solution polymerization. In particular, suspension polymerization can easily establish the preferable physical properties of the magnetic toner of the present invention, and is very preferred.

The suspension polymerization is a process in which the polymerizable monomer, the magnetic powder and the colorant (and further optionally a polymerization initiator, a cross-linking agent, the charge control agent and other additives) are uniformly dissolved or dispersed to make up a polymerizable monomer composition, and thereafter this polymerizable monomer composition is dispersed in a continuous phase (e.g., an aqueous phase) containing a dispersion stabilizer, by means of a suitable stirrer to carry out polymerization to produce toner particles having the desired particle diameters. With the magnetic toner having the toner particles obtained by this suspension polymerization (hereinafter simply "polymerization toner"), the individual toner particles are uniform and substantially spherical, and hence the magnetic toner satisfying the requirement of the physical properties, the average circularity of 0.960 or more, preferable in the present invention, can be easily obtained. Moreover, such a toner can also have relatively uniform charge quantity distribution, and hence can be expected to enhance image quality.

A production process carried out by suspension polymerization is described below. The polymerization toner may commonly be produced in the following way: To a toner composition, i.e., a polymerizable monomer composition prepared by appropriately adding to a polymerizable monomer(s) to be made into the binder resin, the magnetic powder, the release agent, a plasticizer, the charge control agent, a cross-linking agent, and optionally the colorant, which are components necessary for toner, and other additives as exemplified by a high polymer and a dispersant are added, uniformly dissolved or dispersed by means of a dispersion machine or the like, and suspended in an aqueous phase containing a dispersion stabilizer.

In the production of the polymerization toner of the present invention, the polymerizable monomer in the polymerizable monomer composition may include the following: styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture. Of the foregoing monomers, styrene or a styrene derivative may preferably be used alone or in the form of a mixture with other monomers, in view of the developing performance and running performance of the toner.

In the production of the polymerization toner of the present invention, the polymerization may be carried out by adding a resin in the polymerizable monomer composition. For example, a polymerizable monomer component containing a hydrophilic functional group such as an amino group, a carboxylic acid group, a hydroxyl group, a sulfonic acid group, a glycidyl group or a nitrile group can not be used as it is because it is water-soluble and dissolves in an aqueous suspension to cause emulsion polymerization. Accordingly, when such a monomer component should be introduced into toner particles, it may preferably be used in the form of a copolymer such as a random copolymer, a block copolymer or a graft copolymer, with a vinyl compound such as styrene or ethylene, in the form of a polycondensation product such as polyester or polyamide, or in the form of a polyaddition product such as polyether or polyimine. Where the high polymer containing such a polar functional group is incorporated in the toner particles, such a high polymer becomes localized to toner particle surfaces, and hence a toner having good anti-blocking properties and developing performance can be obtained.

Of these resins, the incorporation of a polyester resin can be greatly effective. This is presumed to be for the following reason. The polyester resin contains many ester linkages, which are functional groups having a relatively high polarity, and hence the resin itself has a high polarity. On account of this polarity, a strong tendency for the polyester to be localized at droplet surfaces is exhibited in the aqueous dispersion medium, and the polymerization proceeds in that state until toner particles are formed. Hence, the polyester resin is localized at toner particle surfaces to establish a uniform surface state and surface composition, so that the toner can have uniform charging performance, and due to a synergistic effect of the good enclosure of the release agent and that uniform charging performance, very good developing performance can be achieved.

As the polyester resin used in the present invention, a saturated polyester resin or an unsaturated polyester resin or both of them may be used under appropriate selection in order to control the performances of the toner such as charging performance, running performance and fixing performance.

In the present invention, normal polyester resins may be used which are constituted of an alcohol component and an acid component. Both of the components are exemplified below.

The alcohol component may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following Formula (I):

(I)

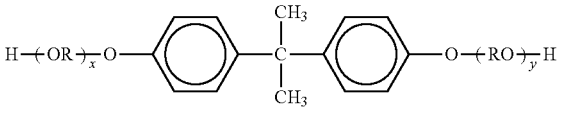

wherein R represents an ethylene group or a propylene group, x and y are each independently an integer of 1 or more, and an average value of x+y is 2 to 10;

or a hydrogenated product of the compound of Formula (I), and a diol represented by the following Formula (II):

(II)

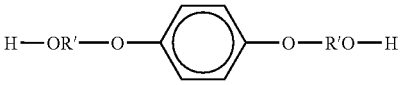

wherein R' represents $—CH_2CH_2—$, $—CH_2CH(CH_3)—$, or $—CH_2—C(CH_3)_2—$;

or a hydrogenated diol of the compound of Formula (II).

A dibasic carboxylic acid may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid or its anhydride, substituted with a lower alkyl group having 6 to 18 carbon atoms or an alkenyl group having 6 to 18 carbon atoms; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, and oxyakylene ethers of novolak phenol resins. The acid component may include polycarboxylic acids such as trimellitic acid, pyromellitic acid, 1,2,3,4-butanetetracarboxylic acid, benzophenonetetracarboxylic acid and anhydrides thereof.

Of the above polyester resins, preferably used is an alkylene oxide addition product of the above bisphenol A, which has superior chargeability and environmental stability and is well balanced in other electrophotographic performances. In the case of this compound, the alkylene oxide may preferably have an average addition molar number of from 2 to 10 in view of fixing performance and running performance.

The polyester resin in the present invention may preferably be composed of from 45 to 55 mol % of the alcohol component and from 55 to 45 mol % of the acid component in the whole components.

The polyester resin may preferably have an acid value of from 0.1 to 50 mgKOH/1 g of resin, in order that the resin may be present at toner particle surfaces in the production of the magnetic toner of the present invention and the resultant toner particles exhibit stable charging performance. If it has an acid value of less than 0.1 mgKOH/1 g of resin, it may be present at the toner particle surfaces in insufficient quantity. If it has an acid value of more than 50 mgKOH/1 g of resin, it tends to adversely affect the charging performance of the toner. In the present invention, it may more preferably have the acid value in the range of from 5 to 35 mgKOH/1 g of resin.

In the present invention, as long as the physical properties of the toner particles obtained are not adversely affected, it is also preferable to use two or more types of polyester resins in combination or to regulate physical properties of the polyester resin by modifying it with, e.g., a silicone compound or a fluoroalkyl group-containing compound.

In the case where a high polymer containing such a polar functional group is used, one having a number-average molecular weight of 3,000 or more is preferable. The polymer having an average molecular weight of less than 3,000 are not preferable because it is apt to concentrate in the vicinity of the surfaces of toner particles to lower developing performance, anti-blocking properties and so forth. It is preferable that the high polymer has a ratio of weight-average particle diameter to number-average molecular weight, Mw/Mn, of from 1.2 to 10.0 from the viewpoint of fixing performance and anti-blocking properties. In addition, the number-average molecular weight and the weight-average particle diameter may be measured by GPC.

For the purpose of improving dispersibility of materials, fixing performance or image characteristics, a resin other than the foregoing may also be added in the monomer composition. The resin usable therefor may include homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins; any of which may be used alone or in the form of a mixture and added preferably in an amount of from 1 to 20 parts by weight based on 100 parts by weight of the polymerizable monomer. If added in an amount of less than 1 part by weight, the effect of the addition may not be sufficiently exhibited. On the other hand, if added in an amount of more than 20 parts by weight, it may be difficult to design various physical properties of the polymerization toner.

As for the polymerization initiator used in the production of the magnetic toner of the present invention, one having a half-life of from 0.5 to 30 hours may be added at the time of polymerization reaction in an amount of from 0.5 to 20 parts by weight based on 100 parts by weight of the polymerizable monomer to carry out polymerization. This enables a polymer having a maximum molecular weight in the region of molecular weight of from 10,000 to 100,000 to be produced, and enables the toner to be endowed with a desirable strength and appropriate melt properties.

The polymerization initiator may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivarate.

When the magnetic toner of the present invention is produced, a cross-linking agent may be added preferably in an amount of from 0.001 to 15% by weight based on based on 100 parts by weight of the polymerizable monomer.

Here, as the cross-linking agent, compounds having at least two polymerizable double bonds may be used, including, e.g., aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

In the process of producing the magnetic toner of the present invention by polymerization, in general, a polymerizable monomer composition prepared by dissolving or dispersing the above toner-composing materials by means of a dispersion machine such as a homogenizer, a ball mill, a colloid mill or an ultrasonic dispersion machine is suspended in an aqueous medium containing a dispersion stabilizer. Here, a high-speed dispersion machine such as a high-speed stirrer or an ultrasonic dispersion machine may be used to bring the magnetic toner particles into the desired particle size at a stretch, so that the particle size distribution of the resulting toner particles can be concentrated in a narrow range.

The polymerization initiator may be added at the same time other additives are added to the polymerizable monomer, or may be mixed immediately before other additives are suspended in the aqueous medium. Also, a polymerization initiator having been dissolved in the polymerizable monomer or solvent may be added before the polymerization reaction is initiated.

After granulation, agitation may be carried out using a usual agitator in such an extent that the state of particles is maintained and the particles can be prevented from floating and settling.

When the magnetic toner of the present invention is produced, any of known surface-active agents or organic or inorganic dispersants may be used as a dispersion stabilizer. In particular, the inorganic dispersants may hardly cause any harmful ultrafine powder and can attain dispersion stability on account of their steric hindrance. Hence, even when reaction temperature is changed, the inorganic dispersants may hardly loose the stability, can be easily washed and may hardly affect toners, and hence they may preferably be used. Examples of such inorganic dispersants may include phosphoric acid polyvalent metal salts such as tricalcium phosphate, magnesium phosphate, aluminum phosphate, zinc phosphate and hydroxylapatite; carbonates such as calcium carbonate and magnesium carbonate; inorganic salts such as calcium metasilicate, calcium sulfate and barium sulfate; and inorganic oxides such as calcium hydroxide, magnesium hydroxide and aluminum hydroxide.

Any of these inorganic dispersants may preferably be used in an amount of from 0.2 to 20 parts by weight based on 100 parts by weight of the polymerizable monomer. The above dispersion stabilizer may be used alone or in combination. In conjunction therewith, a surface-active agent may further be used in an amount of from 0.001 to 0.1 part by weight.

When these inorganic dispersants are used, they may be used as they are. In order to obtain finer particles, particles of the inorganic dispersant may be formed in the aqueous medium. For example, in the case of tricalcium phosphate, a sodium phosphate aqueous solution and a calcium chloride aqueous solution may be mixed under high-speed agitation, whereby water-insoluble calcium phosphate can be formed and more uniform and finer dispersion can be prepared. Here, water-soluble sodium chloride is simultaneously formed as a by-product. However, the presence of such a water-soluble salt in the aqueous medium keeps the polymerizable monomer from being dissolved in water so that it is difficult for ultrafine toner particles to be produced by emulsion polymerization, which is more favorable.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

The magnetic toner of the present invention may have at least one element selected from the group consisting of magnesium, calcium, barium and aluminum, and this element may be present on the surfaces of magnetic toner particles in the total abundance of from 5 to 1,000 ppm, and more preferably from 10 to 500 ppm, based on the weight of the magnetic toner particles. This brings about more improvement in charging uniformity, and is effective in reducing fog and remedying spots around line images. The reason therefor has not been clear, but is assumed to be that electric charges are exchanged between the above divalent or trivalent element such as magnesium, calcium, barium or aluminum and a magnetic material having a specific element, and the element acts as a charging auxiliary agent.

However, if any of these elements is in a level (or abundance) of less than 5 ppm, the above effect is not exhibited, and if being in a level of more than 1,000 ppm, the toner may have a low charge quantity especially in a high-temperature and high-humidity environment to cause fog greatly, which is undesirable.

Where a plurality of elements of the magnesium, calcium, barium and aluminum are present on the toner particle surfaces, they should be in a level of from 5 to 1,000 ppm in total.

Among such elements, magnesium and calcium are preferred because they are effective especially in preventing the charge-up.

In addition, such elements may preferably be present on the toner particle surfaces, and their level may be controlled by a method in which a compound(s) containing the elements is/are externally added, or by a method and conditions for washing the dispersant described previously.

In the present invention, magnesium, calcium, barium and/or aluminum present on the toner particle surfaces is/are meant to be an element or elements present thereon in the state external additives have been removed by putting the toner in a solvent incapable of dissolving the toner, such as isopropanol, and applying vibrations thereto by means of an ultrasonic cleaner.

As to the presence level (or abundance) of the above elements, the element(s) may quantitatively be determined by applying a known analytical method such as fluorescent X-ray analysis or plasma emission spectrometry (ICP spectroscopy) to the toner particles after the external additives have been removed.

In Examples given later, the measurement of each element is carried out by fluorescent X-ray analysis in accordance with JIS K 0119.

(1) Regarding Instrument being Used:

Fluorescent X-ray analyzer 3080 (manufactured by Rigaku Corporation).

Sample press molding machine (manufactured by Maekawa Testing Machine MFG Co., Ltd.).

(2) Regarding Preparation of Calibration Curve:

A composite compound to be subjected to quantitative determination is 5-level externally added using a coffee mill to prepare a sample. This sample is press-molded by means of the sample press molding machine. The [M]Kα peak angle (a) in the composite compound is determined from the 2θ table. Calibration samples are put into the fluorescent X-ray analyzer, and the sample chamber is evacuated to a vacuum. The X-ray intensity of each sample is determined under the following conditions to prepare a calibration curve (weight ratio: expressed by ppm).

(3) Regarding Measuring Conditions:

Measuring potential, voltage: 50 kV, 50 to 70 mA.

2θ Angle: a.

Crystal plate: LiF.

Measuring time: 60 seconds.

(4) Regarding Quantitative Determination of the Above Elements in Toner Particles:

A sample is molded in the same manner as that for the calibration curve. Thereafter, the X-ray intensity is determined under the like measuring conditions, and the content is calculated from the calibration curve.

In addition, where the compound having the magnesium, calcium, barium and/or aluminum element(s) is not present except for the toner particle surfaces, the presence level of each element is determined by the above method. Where, however, any of these elements is/are present except for the toner particle surfaces, the presence level of each element is determined in the following way.

First, the presence level of each element is determined by the above method. This is regarded as presence level X.

Next, toner particles from which external additives have been removed are agitated in concentrated nitric acid for 1 hour, and then thoroughly washed with pure water, followed by drying, and the presence level of each element is determined by the above method. This is regarded as presence level Y.

The presence level of each element on toner particle surfaces may be found from the difference between X and Y, i.e., the value of X−Y.

In addition, even when the above element(s) is/are contained in magnetite or the like, the magnetite is passivated with the concentrated nitric acid, and is not dissolved. Hence, it is possible to measure the presence level of only the element(s) on the toner particle surfaces.

In the step of polymerization described previously, the polymerization may be carried out at a polymerization temperature set at 40° C. or above, and commonly at a temperature of from 50° C. to 90° C. Where the polymerization is carried out in that temperature range, the release agent or wax or the like to be enclosed in particles becomes deposited by phase separation and more perfectly enclosed in particles. In order to consume residual polymerizable monomers, the reaction temperature may be raised to 90° C. to 150° C. at the terminal stage of the polymerization reaction.

In the magnetic toner of the present invention, it is preferable that after the polymerization is completed, the polymerization toner particles (toner base particles) may be filtered, washed and dried by known methods, and an inorganic fine powder may optionally be mixed so as to be deposited on the magnetic toner particle surfaces. Also, a step of classification may be added to the production process to remove coarse powder and fine powder.

In the present invention, it is also a preferred embodiment that the magnetic toner has an inorganic fine powder having a number-average primary particle diameter of from 4 nm to 80 nm which is added as a fluidity improver. The inorganic fine powder is added primarily in order to improve the fluidity of the toner and to uniformly charge the toner particles, and it is also a preferred embodiment that the inorganic fine powder is treated, e.g., hydrophobic-treated so as to be endowed with a function of regulating the charge quantity of toner and improving the environmental stability of toner.

If the inorganic fine powder having a number-average primary particle diameter of more than 80 nm is added, good fluidity of the magnetic toner cannot be achieved, so that the toner particles are liable to be unevenly charged to cause problems of fog, decrease in image density and increase in toner consumption. On the other hand, if the inorganic fine powder having a number-average primary particle diameter of less than 4 nm is added, the inorganic fine powder is apt to agglomerate, and tends to behave not as primary particles but as agglomerates having broad particle size distribution which are so strongly agglomerative as to be difficult to break up even by disintegration treatment, so that the agglomerates may be involved in development or scratch the image-bearing member or toner-carrying member to cause image defects.

In the present invention, the number-average primary particle diameter of the inorganic fine powder may be measured in the following way: On a photograph of toner particles taken under magnification on a scanning electron microscope, while making a comparison with a photograph of toner particles mapped with elements included in the inorganic fine powder, by an elemental analysis means such as XMA (X-ray micro-analyzer) attached to the scanning electron microscope, at least 100 primary particles of the inorganic fine powder in the state of adhesion to or liberation from toner particle surfaces are measured to determine the number-average primary particle diameter.

As the inorganic fine powder in the present invention, fine silica powder, fine titanium oxide powder, fine alumina powder or the like may be used.

As the fine silica powder, the following may be cited: e.g., what is called dry-process silica or fumed silica produced by vapor phase oxidation of silicon halides and what is called wet-process silica produced from water glass or the like, both of which may be used. The dry-process silica is preferred, as having less silanol groups on the particle surfaces and the particle interiors of the fine silica powder and leaving less production residues such as $Na_2 2$ and $SO_3^{2-}$. In the production step for the dry-process silica, it is also possible to use, e.g., other metal halide such as aluminum chloride or titanium chloride together with the silicon halide to give a composite fine powder of silica with other metal oxide. The fine silica powder includes these as well.

The inorganic fine powder having a number-average primary particle diameter of from 4 nm to 80 nm may be added preferably in an amount of from 0.1 to 3.0% by weight based on the weight of the toner particles. When added in an amount of less than 0.1% by weight, the effect brought about by the addition of the inorganic fine powder is not satisfactory. When added in an amount of more than 3.0% by weight, the toner may have poor fixing performance.

The content of the inorganic fine powder may be determined by fluorescent X-ray analysis and using a calibration curve prepared from a standard sample.

In the present invention, the inorganic fine powder may preferably be one subjected to hydrophobic-treatment because the toner can be improved in environmental stability. Where the inorganic fine powder added to the magnetic toner has moistened, the toner particles may be charged in a very low quantity and tend to have non-uniform charge quantity and to cause toner scatter.

As a treating agent used for such hydrophobic treatment, usable are treating agents such as a silicone varnish, various types of modified silicone varnish, a silicone oil, various types of modified silicone oil, a silane compound, other organic silicon compound and an organotitanium compound, any of which may be used alone or in combination.

In particular, those having been treated with a silicone oil are preferred. Those obtained by subjecting the inorganic fine powder to hydrophobic treatment with a silane compound and, simultaneously with or after the treatment, treatment with a silicone oil are more preferred in order to maintain the charge quantity of the toner particles at a high level even in a high humidity environment and to prevent toner scatter.

As a method for such treatment of the inorganic fine powder, for example the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity at 25° C. of from 10 to 200,000 $mm^2/s$, and more preferably from 3,000 to 80,000 $mm^2/s$. If the viscosity is less than 10 $m^2/s$, the inorganic fine powder may have no stability, and the image quality may be lowered because of thermal and mechanical stress. If the viscosity is more than 200,000 $mm^2/s$, it tends to be difficult to carry out uniform treatment.

As the silicone oil to be used, particularly preferred are, e.g., dimethylsilicone oil, methylphenylsilicone oil, α-methylstyrene modified silicone oil, chlorophenylsilicone oil and fluorine modified silicone oil.

Methods for treating the inorganic fine powder with the silicone oil include, for example, a method in which the inorganic fine powder treated with a silane compound and the silicone oil is directly mixed by means of a mixer such as Henschel mixer, or a method in which the silicone oil is sprayed on the inorganic fine powder. Alternatively, a method may also be used in which the silicone oil is dissolved or dispersed in a suitable solvent and thereafter the inorganic fine powder is added thereto and mixed, followed by removal of the solvent. In view of such an advantage that agglomerates of the inorganic fine powder are reduced, the method making use of a sprayer is preferred.

The silicone oil may be used for the treatment in an amount of from 1 to 40 parts by weight, and preferably from 3 to 35 parts by weight, based on 100 parts by weight of the inorganic fine powder. If the silicone oil is in a too small quantity, the inorganic fine powder can not be made well hydrophobic. If it is in a too large quantity, problems such as fogging are apt to occur.

In order to endow the magnetic toner with good fluidity, the inorganic fine powder used in the present invention may preferably be one having a specific surface area ranging from 20 to 350 $m^2/g$, and more preferably from 25 to 300 $m^2/g$, as measured by the BET method utilizing nitrogen adsorption.

The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In order to improve cleaning performance and so forth, inorganic or organic fine particles close to a sphere having a primary particle diameter of more than 30 nm (preferably having a BET specific surface area of less than 50 $m^2/g$), and more preferably a primary particle diameter of more than 50 nm (preferably having a BET specific surface area of less than 30 $m^2/g$), may further be added to the magnetic toner of the present invention. This is also one of preferred embodiments. For example, spherical silica particles, spherical polymethyl silsesquioxane particles and spherical resin particles may preferably be used.

In the magnetic toner of the present invention, other additives may further be used in small quantities as long as their addition substantially does not adversely affect the magnetic toner, which may include, e.g., lubricant powders such as polyethylene fluoride powder, zinc stearate powder and polyvinylidene fluoride powder; abrasives such as cerium oxide powder, silicon carbide powder and strontium titanate powder; and anti-caking agents; and reverse-polarity organic particles and inorganic particle as a developability improver. These additives may also be used after hydrophobic treatment of their particle surfaces.

An example of an image forming apparatus in which the magnetic toner of the present invention is preferably usable is specifically described below with reference to FIG. 2.

Figure 2:
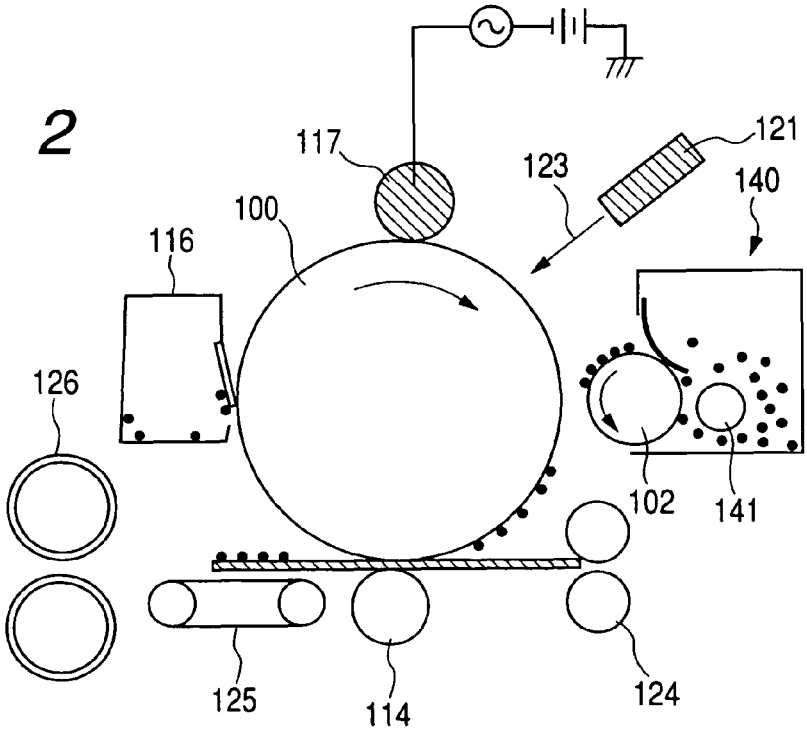
FIG. 2 is a view showing an example of an image forming apparatus used in Examples of the present invention.

In FIG. 2, reference numeral 100 denotes an electrostatically charged image bearing member; 102, a toner carrying member; 114, a transfer roller; 116, a cleaner; 117, a primary charging roller; 121, an exposure unit; 123, exposure light; 124, a paper feed roller; 125, a transport member; 126, a fixing assembly; 140, a developing assembly; and 141, an agitation member. Then, the electrostatically charged image bearing member 100 is electrostatically charged to −600 V by means of the primary charging roller 117 (applied voltages thereto are an AC voltage of 2.0 kVpp and a DC voltage of −620 Vdc). Then, the electrostatically charged image bearing member 100 is irradiated with exposure light 123 by means of the exposure unit 121. An electrostatic latent image formed on the electrostatically charged image bearing member 100 is developed with a one-component magnetic toner by means of the developing assembly 140 to form a toner image, then transferred to a transfer material by means of the transfer roller 114 brought into contact with the electrostatically charged image bearing member (photosensitive member) via the transfer material. The transfer material holding the toner image thereon is transported to the fixing assembly 126 by the transport member 125 and so forth, and the toner image is fixed onto the transfer material. The toner remaining partly on the photosensitive member is removed by the cleaner 116 to clean the surface.

EXAMPLES

The present invention is described below in greater detail by giving production examples and working examples, which are by no means construed as limiting the present invention.

(1) Production of Magnetic Powder:

Production of Magnetic Powder 1

In an ferrous sulfate aqueous solution, 1.0 to 1.1 equivalent weight of a sodium hydroxide solution, based on iron elements, $P_2O_5$ equivalent to an amount of 0.15% by weight in terms of phosphorus elements, based on iron element, and $SiO_2$ equivalent to an amount of 0.55% by weight in terms of silicon elements, based on iron elements, were mixed to prepare an aqueous solution containing ferrous hydroxide.

Keeping this aqueous solution at pH 8.0, air was blown therein, during which oxidation reaction was carried out at 80° C. to prepare a slurry having seed crystals.

Next, an aqueous ferrous sulfate solution was so added to this slurry as to be from 0.9 to 1.2 equivalent weight based on the initial alkali quantity (sodium component of sodium hydroxide). Thereafter, the slurry was kept at pH 7.6, and air was blown into it, during which the oxidation reaction was allowed to proceed to prepare a slurry containing magnetic iron oxide. This slurry was filtered and washed and thereafter this water-containing slurry was taken out once. At this time point, the water-containing sample was collected in a small quantity to measure its water content previously. Then, without being dried, this water-containing sample was introduced into a different aqueous medium, and while stirring and circulating the slurry, thoroughly re-dispersed by means of a pin mill, and then, pH of the dispersion thus formed was adjusted to about 4.8, and with thorough stirring, an n-hexyltrimethoxysilane compound was added in an amount of 1.5 parts by weight based on 100 parts by weight of the magnetic iron oxide (the quantity of the magnetic iron oxide was calculated in terms of the value found by subtracting the water content from the water-containing sample) to carry out hydrolysis. Thereafter, while thoroughly stirring and circulating the slurry, dispersion was carried out by using a pin mill, and pH of the dispersion was adjusted to about 8.9, where hydrophobic treatment was carried out. The hydrophobic magnetic powder thus produced was filtered with a drum filter, then sufficiently washed, followed by drying at 100° C. for 15 minutes and at 90° C. for 30 minutes. The resulting particles were subjected to disintegration treatment to produce Magnetic Powder 1 having a volume-average particle diameter (Dv) of 0.24 μm. Physical properties of Magnetic Powder 1 are shown in Table 1.

Production of Magnetic Powder 2

Magnetic Powder 2 was produced in the same manner as in Production of Magnetic Powder 1 except that the amount of n-hexyltrimethoxysilane was changed from 1.5 parts by weight to 0.8 part by weight. Physical properties of Magnetic Powder 2 thus produced are shown in Table 1.

Production of Magnetic Powder 3

Magnetic Powder 3 was produced in the same manner as in Production of Magnetic Powder 1 except that the amount of n-hexyltrimethoxysilane was changed from 1.5 parts by weight to 2.6 part by weight. Physical properties of Magnetic Powder 3 thus produced are shown in Table 1.

Production of Magnetic Powder 4

Magnetic Powder 4 was produced in the same manner as in Production of Magnetic Powder 1 except that the amount of n-hexyltrimethoxysilane was changed from 1.5 parts by weight to 3.1 part by weight. Physical properties of Magnetic Powder 4 thus produced are shown in Table 1.

Production of Magnetic Powder 5

Magnetic Powder 5 was produced in the same manner as in Production of Magnetic Powder 1 except that the dispersion with the pin mill was not carried out and drying conditions were changed to 120° C. for 2 hours. Physical properties of Magnetic Powder 5 thus produced are shown in Table 1.

Production of Magnetic Powder 6

Magnetic Powder 6 was produced in the same manner as in Production of Magnetic Powder 1 except that the dispersion with the pin mill was not carried out and drying conditions were changed to 60° C. for 4 hours. Physical properties of Magnetic Powder 6 thus produced are shown in Table 1.

Production of Magnetic Powder 7

Magnetic Powder 7 was produced in the same manner as in Production of Magnetic Powder 1 except that $P_2O_5$ and $SiO_2$ were changed to $P_2O_5$ equivalent to an amount of 0.08% by weight in terms of phosphorus elements and $SiO_2$ equivalent to an amount of 0.50% by weight in terms of silicon elements. Physical properties of Magnetic Powder 7 thus produced are shown in Table 1.

Production of Magnetic Powder 8

Magnetic Powder 8 was produced in the same manner as in Production of Magnetic Powder 1 except that $P_2O_5$ and $SiO_2$ were changed to $P_2O_5$ equivalent to an amount of 0.04% by weight in terms of phosphorus elements and $SiO_2$ equivalent to an amount of 0.25% by weight in terms of silicon elements. Physical properties of Magnetic Powder 8 thus produced are shown in Table 1.

Production of Magnetic Powder 9

Magnetic Powder 9 was produced in the same manner as in Production of Magnetic Powder 1 except that $P_2O_5$ and $SiO_2$ were changed to $P_2O_5$ equivalent to an amount of 0.10% by weight in terms of phosphorus elements and $SiO_2$ equivalent to an amount of 0.9% by weight in terms of silicon elements. Physical properties of Magnetic Powder 9 thus produced are shown in Table 1.

Production of Magnetic Powder 10

Magnetic Powder 10 was produced in the same manner as in Production of Magnetic Powder 1 except that $P_2O_5$ and $SiO_2$ added were changed to $P_2O_5$ equivalent to an amount of 0.27% by weight in terms of phosphorus elements and $SiO_2$ equivalent to an amount of 0.50% by weight in terms of silicon elements. Physical properties of Magnetic Powder 10 thus produced are shown in Table 1.

Production of Magnetic Powder 11

Magnetic Powder 11 was obtained in the same manner as in Production of Magnetic Powder 1 except that the amount of the air blown in the second-time oxidation reaction was reduced by 20%. Physical properties of Magnetic Powder 11 thus produced are shown in Table 1.

Production of Magnetic Powder 12

Magnetic Powder 12 was produced in the same manner as in Production of Magnetic Powder 1 except that the amount of the air blown in the second-time oxidation reaction was reduced by 35%. Physical properties of Magnetic Powder 12 thus produced are shown in Table 1.

Production of Magnetic Powder 13

Magnetic Powder 13 was produced in the same manner as in Production of Magnetic Powder 1 except that the amount of the air blown in the second-time oxidation reaction was increased by 30%. Physical properties of Magnetic Powder 10 thus produced are shown in Table 1.

TABLE 1

| Magnetic Powder: | P content | Si content | P/Si | Silane compound coverage Parts by (wt. %) | Volume = average particle diam. (μm) | Vol. = av. variation coefficient | Residual magneti- zation ($Am^2/kg$) | Saturation magneti- zation ($Am^2/kg$) | *Particle size in solvent 50% Volume diam. | *Particle size in solvent SD value | Liberation percentage (%) |
|---|---|---|---|---|---|---|---|---|---|---|---|
| 1 | 0.15 | 0.55 | 0.27 | 1.5 | 0.24 | 16 | 3.3 | 70.2 | 0.5 | 0.2 | 12 |
| 2 | 0.15 | 0.55 | 0.27 | 0.8 | 0.24 | 16 | 3.3 | 70.3 | 1.5 | 0.4 | 1 |
| 3 | 0.15 | 0.55 | 0.27 | 2.6 | 0.24 | 16 | 3.2 | 70.1 | 0.7 | 0.3 | 23 |
| 4 | 0.15 | 0.55 | 0.27 | 3.1 | 0.24 | 16 | 3.3 | 69.9 | 0.9 | 0.4 | 32 |
| 5 | 0.15 | 0.55 | 0.27 | 1.5 | 0.24 | 16 | 3.7 | 70.8 | 1.2 | 0.4 | 9 |
| 6 | 0.15 | 0.55 | 0.27 | 1.5 | 0.24 | 16 | 3.2 | 70.2 | 1.6 | 0.6 | 34 |
| 7 | 0.08 | 0.50 | 0.16 | 1.5 | 0.25 | 15 | 4.1 | 71.2 | 0.7 | 0.2 | 10 |
| 8 | 0.04 | 0.25 | 0.16 | 1.5 | 0.27 | 12 | 4.8 | 70.9 | 0.8 | 0.3 | 15 |
| 9 | 0.10 | 0.90 | 0.11 | 1.5 | 0.23 | 31 | 3.1 | 66.5 | 0.9 | 0.7 | 16 |
| 10 | 0.27 | 0.50 | 0.54 | 1.5 | 0.21 | 34 | 3.2 | 69.1 | 1.0 | 0.6 | 11 |
| 11 | 0.15 | 0.55 | 0.27 | 1.5 | 0.31 | 19 | 2.8 | 67.8 | 0.7 | 0.2 | 15 |
| 12 | 0.15 | 0.55 | 0.27 | 1.5 | 0.37 | 22 | 2.4 | 65.8 | 1.1 | 0.3 | 19 |
| 13 | 0.15 | 0.55 | 0.27 | 1.5 | 0.13 | 9 | 5.6 | 71.3 | 0.4 | 0.2 | 8 |

Silane compound coverage: the coating amount of silane compound

*In Table 1, "Particle size in solvent" refers to the 50% volume diameter of the magnetic powder as measured in styrene/n-butyl acrylate, and the SD value represented by Expression (1).

(2) Production of Polymer Having Sulfonic Acid Group:

Production of Polymer 1

Having Sulfonic Acid Group

Into a pressurizable reaction vessel furnished with a reflux tube, a stirrer, a thermometer, a nitrogen feed pipe, a dropping unit and an evacuation unit, 250 parts of methanol, 150 parts of 2-butanone and 100 parts of 2-propanol as solvents and 83 parts of styrene, 12 parts of butyl acrylate and 4 parts of 2-acrylamido-2-methylpropanesulfonic acid (hereinafter "AMPS") as monomers were introduced, and heated to reflux temperature with stirring, followed by dropwise adding a solution prepared by diluting 0.45 part of a polymerization initiator t-butyl peroxy-2-ethylhexanoate with 20 parts of 2-butanone over a period of 30 minutes, and the stirring was continued for 5 hours, and then a solution prepared by diluting 0.28 part of t-butyl peroxy-2-ethylhexanoate with 20 parts of 2-butanone was further dropwise added over a period of 30 minutes, followed by stirring for further 5 hours to carry out polymerization.

Thereafter, the reaction mixture was introduced into methanol to precipitate a polymer to produce Polymer 1 Having Sulfonic Acid Group. The resulting polymer had a glass transition temperature (Tg) of 70.4° C. and a weight-average molecular weight of 23,000.

Production of Polymer 2

Having Sulfonic Acid Group

Polymer 2 Having Sulfonic Acid Group having a glass transition temperature (Tg) of 70.1° C. and a weight-average molecular weight of 22,000 was produced in the same manner as in Polymer 1 Having Sulfonic Acid Group except that the amount of the AMPS was changed to 0.5 part by weight.

Production of Polymer 3

Having Sulfonic Acid Group

Polymer 3 Having Sulfonic Acid Group having a glass transition temperature (Tg) of 72.4° C. and a weight-average molecular weight of 21,000, was produced in the same manner as in Polymer 1 Having Sulfonic Acid Group except that the amount of the AMPS was changed to 9 parts by weight.

(3) Production of Magnetic Toner:

Production of Magnetic Toner 1

In 720 parts by weight of ion-exchange water, 450 parts by weight of a 0.1-M $Na_3PO_4$ aqueous solution was introduced, followed by heating to 60° C. To the resulting mixture, 67.7 parts of a 1.0-M $CaCl_2$ aqueous solution was added to prepare an aqueous medium containing a dispersion stabilizer.

| | (by weight) |
|---|---|
| Styrene | 74 parts |
| n-Butyl acrylate | 26 parts |
| Divinylbenzene | 0.50 part |
| Saturated polyester resin (a reaction product of terephthalic acid with an ethylene oxide addition product of bisphenol A; Mn: 4,000; Mw/Mn: 2.8; acid value: 11 mgKOH/g) | 10 parts |
| Polymer 1 Having Sulfonic Acid Group | 1.5 parts |
| Magnetic Powder 1 | 90 parts |

Materials formulated as shown above were uniformly dispersed and mixed by means of an attritor (manufactured by Mitsui Miike Engineering Corporation) to prepare a monomer composition. The monomer composition thus prepared was heated to 60° C., and 10 parts of paraffin wax (maximum endothermic peak in DSC: 78° C.) was added and mixed and dissolved. To the resulting mixture, 5 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of $N_2$, using CLEAMIX (manufactured by MTECHNIQUE Co., Ltd.) at 12,000 rpm to carry out granulation. Thereafter, the granulated product was stirred with a paddle stifling blade, where the reaction was carried out at 60° C. for 8 hours. After the reaction was completed, the suspension formed was cooled, and hydrochloric acid was added to adjust the pH to 0.8, followed by stifling for 2 hours and filtration and then, was further washed with 2,000 parts by weight or more of ion-exchange water three times, followed by sufficient aeration and drying to produce Toner Particles 1 (toner base particles).

100 parts by weight of this Toner Particles 1 and 1.0 part by weight of hydrophobic fine silica powder produced by treating silica of 12 nm in number-average primary particle diameter with hexamethyldisilazane and thereafter with silicone oil and having a BET specific surface area of 120 $m^2/g$ after treatment, were mixed by means of Henschel mixer (manufactured by Mitsui Miike Engineering Corporation) to produce Magnetic Toner 1 having a weight-average particle diameter of 6.5 μm.

Physical properties of Magnetic Toner 1 are shown in Table 2.

Production of Magnetic Toner 2

Magnetic Toner 2 was produced in the same manner as in Production of Magnetic Toner 1 except that in place of Magnetic Powder 1, Magnetic Powder 2 was used. Physical properties of Magnetic Toner 2 are shown in Table 2.

Production of Magnetic Toner 3

Magnetic Toner 3 was produced in the same manner as in Production of Magnetic Toner 1 except that in place of Magnetic Powder 1, Magnetic Powder 3 was used. However, toner particles somewhat agglomerated during polymerization reaction, and hence classification was carried out to produce Magnetic Toner 3. Physical properties of Magnetic Toner 3 are shown in Table 2.

Production of Magnetic Toner 4

Magnetic Toner 4 was produced in the same manner as in Production of Magnetic Toner 1 except that in place of Magnetic Powder 1, Magnetic Powder 4 was used. Physical properties of Magnetic Toner 4 are shown in Table 2.

Production of Magnetic Toner 5

Magnetic Toner 5 was produced in the same manner as in Production of Magnetic Toner 1 except that in place of Magnetic Powder 1, Magnetic Powder 5 was used. Physical properties of Magnetic Toner 5 are shown in Table 2.

Production of Magnetic Toner 6

Magnetic Toner 6 was produced in the same manner as in Production Magnetic Toner 1 except that in place of Magnetic Powder 1, Magnetic Powder 6 was used. Physical properties of Magnetic Toner 6 are shown in Table 2.

Production of Magnetic Toner 7

Magnetic Toner 7 was produced in the same manner as in Production of Magnetic Toner 1 except that in place of Magnetic Powder 1, Magnetic Powder 7 was used. Physical properties of Magnetic Toner 7 are shown in Table 2.

Production of Magnetic Toner 8

Magnetic Toner 8 was produced in the same manner as in Production of Magnetic Toner 1 except that in place of Magnetic Powder 1, Magnetic Powder 8 was used. Physical properties of Magnetic Toner 8 are shown in Table 2.

Production of Magnetic Toner 9

Magnetic Toner 9 was produced in the same manner as in Production of Magnetic Toner 1 except that in place of Magnetic Powder 1, Magnetic Powder 9 was used. Physical properties of Magnetic Toner 9 are shown in Table 2.

Production of Magnetic Toner 10

Magnetic Toner 10 was produced in the same manner as in Production of Magnetic Toner 1 except that in place of Magnetic Powder 1, Magnetic Powder 10 was used. Physical properties of Magnetic Toner 10 are shown in Table 2.

Production of Magnetic Toner 11

Magnetic Toner 11 was produced in the same manner as in Production of Magnetic Toner 1 except that in place of Magnetic Powder 1, Magnetic Powder 11 was used. Physical properties of Magnetic Toner 11 are shown in Table 2.

Production of Magnetic Toner 12

Magnetic Toner 12 was produced in the same manner as in Production of Magnetic Toner 1 except that in place of Magnetic Powder 1, Magnetic Powder 12 was used. Physical properties of Magnetic Toner 12 are shown in Table 2.

Production of Magnetic Toner 13

Magnetic Toner 13 was produced in the same manner as in Production of Magnetic Toner 1 except that in place of Magnetic Powder 1, Magnetic Powder 13 was used. Physical properties of Magnetic Toner 13 are shown in Table 2.

Production of Magnetic Toner 14

Magnetic Toner 14 was produced in the same manner as in Production of Magnetic Toner 1 except that, in place of Polymer 1 Having Sulfonic Acid Group, Polymer 2 Having Sulfonic Acid Group was used. Physical properties of Magnetic Toner 14 are shown in Table 2.

Production of Magnetic Toner 15

Magnetic Toner 15 was produced in the same manner as in Production of Magnetic Toner 1 except that, in place of Polymer 1 Having Sulfonic Acid Group, Polymer 3 Having Sulfonic Acid Group was used. Physical properties of Magnetic Toner 15 are shown in Table 2.

Production of Magnetic Toner 16

Magnetic Toner 16 was produced in the same manner as in Production of Magnetic Toner 1 except that after the reaction was completed, hydrochloric acid was added to adjust the pH to 0.8, followed by stirring for 2 hours and thereafter filtration, and then washing with 2,000 parts by weight or more of ion-exchange water twice, and preparing a slurry, and hydrochloric acid was added to the slurry to adjust the pH to 0.8, followed by stirring for 2 hours and filtration, and then washing with 2,000 parts by weight or more of ion-exchanged water three times. Physical properties of Magnetic Toner 16 are shown in Table 2.

Production of Magnetic Toner 17

Magnetic Toner 17 was rpoduced in the same manner as in Production of Magnetic Toner 1 except that after the reaction was completed, hydrochloric acid was added to adjust the pH to 3.0, followed by stirring for 2 hours and filtration, and then washing with 2,000 parts by weight or more of iron-exchange water twice. Physical properties of Magnetic Toner 17 are shown in Table 2.

TABLE 2

Toner Physical Properties

| Magnetic Toner | Number = average particle diameter (μm) | Average circularity | Mode circularity | E/A $\times 10^{-4}$ | Calcium level on toner particle surfaces (ppm) |
|---|---|---|---|---|---|
| 1 | 6.5 | 0.981 | 1 | 24 | 120 |
| 2 | 5.8 | 0.974 | 1 | 25 | 120 |
| 3 | 6.8 | 0.977 | 1 | 24 | 130 |
| 4 | 7.2 | 0.975 | 1 | 24 | 110 |
| 5 | 6.2 | 0.974 | 1 | 25 | 130 |
| 6 | 5.6 | 0.972 | 1 | 23 | 120 |
| 7 | 6.4 | 0.980 | 1 | 24 | 110 |
| 8 | 6.8 | 0.980 | 1 | 25 | 140 |
| 9 | 6.5 | 0.975 | 1 | 25 | 120 |
| 10 | 6.5 | 0.977 | 1 | 24 | 150 |
| 11 | 6.3 | 0.976 | 1 | 23 | 100 |
| 12 | 6.7 | 0.973 | 1 | 24 | 120 |
| 13 | 6.2 | 0.982 | 1 | 25 | 110 |
| 14 | 6.3 | 0.980 | 1 | 2 | 110 |
| 15 | 6.8 | 0.979 | 1 | 52 | 150 |
| 16 | 6.4 | 0.981 | 1 | 24 | 3 |
| 17 | 6.5 | 0.981 | 1 | 24 | 1,080 |

Example 1

Image Forming Apparatus

Using an image forming apparatus, remodeled LPB-1760 (a laser beam printer manufactured by CANON INC.), images were reproduced under the following conditions.

As a primary-charging roller, a rubber roller was used which was a charging member of a charging assembly. The rubber roller with conductive carbon dispersed therein, coated with a nylon resin, was brought into contact (contact pressure: 40 g/cm) with the photosensitive member (electrostatically charged image bearing member), and a bias generated by superposing an AC voltage of 1.2 kVpp on a DC voltage of −620 V was applied to uniformly charge the surface of the photosensitive member. Subsequently to the charging, image areas were exposed to laser light (exposure light) to form electrostatic latent images (dark-area potential Vd was −600 V, and light-area potential VL was −120 V).

The gap between the photosensitive member and a developing sleeve (magnetic-toner carrying member) was set to be 270 μm. A developing sleeve composed of a surface-blasted aluminum cylinder of 12 mm in diameter on which a resin layer constituted as shown below and having a layer thickness of about 7 μm and a JIS center-line average roughness (Ra) of 1.2 μm was formed, was used as a magnetic-toner carrying member. Also, a magnet roller whose developing magnetic pole had a magnetic flux density of 750 gausses was installed in the developing sleeve. As the toner control member, a blade made of urethane of 1.0 mm in thickness and 0.50 mm in free length was brought into touch with the developing sleeve at a linear pressure of 19.6 N/m (20 g/cm).

| | (by weight) |
|---|---|
| Phenol resin | 100 parts |
| Graphite (particle diameter: about 7 μm) | 90 parts |
| Carbon black | 10 parts |

Next, as the development bias, the alternating electric field was set to be 1.6 kVpp and a frequency of 2,200 Hz, and the DC voltage (Vdc) was so set as to effect development faithful to latent images (so set that a 4-dot line latent image of 200 μm in width was developed into a line of 200 μm in width) (in Example 1, stated specifically, set at −420 V).

Under such conditions, using Magnetic Toner 1, 4,000-sheet image reproduction tests were conducted in a high-temperature and high-humidity environment (32.5° C., 80% RH) and in a low-temperature and low-humidity environment (15° C., 10% RH) in an intermittent mode, using an image formed of 8-point A-letters and having a print percentage of 2%. As a result, no fog appeared on non-image areas before and after running (extensive operation) in both the environments, and images with high definition were obtained having image density of 1.4 or more and were also free of any spots around line images.

A 2,000-sheet image reproduction test was also conducted in a normal-temperature and normal-humidity environment (23° C., 60% RH) and in the continuous mode, using an image formed of 8-point A-letters and having a print percentage of 4%. The toner consumption (mg/page) was determined from a change in weight of the developing assembly before and after running (extensive operation). As a result, the toner consumption was 33.4 mg/page, where the toner consumption was found to be vastly reduced as compared with conventional 50 to 55 mg/page.

The evaluation results in the high-temperature and high-humidity environment are shown in Table 3, and the evaluation results in the low-temperature and low-humidity environment and the toner consumption in the normal-temperature and normal-humidity environment are shown in Table 4. In addition, in all the evaluations, A4-size paper of 75 g/m$^2$ in basis weight was used as the recording medium.

Image Density:

To evaluate image density, solid images were formed, and the image density of the solid images was measured with Macbeth reflection densitometer (manufactured by Macbeth Co.).

Fog:

White images were reproduced, and fog on paper was measured and judged according to the following criteria. Here, the fog was measured with REFLECTOMETER MODEL TC-6DS, manufactured by Tokyo Denshoku Co., Ltd. As a filter, a green filter was used, and the fog was calculated according to the following expression (4).

Fog (%)=(reflectance (%) of reference paper)−(reflectance (%) of sample non-image area). Expression (4):

In addition, fog was judged according to criteria shown below.

A: Very good (less than 1.5%).

B: Good (1.5% or more to less than 2.5%).

C: Normal (2.5% or more to less than 4.0%).

D: Poor (4% or more).

Spots Around Line Images:

To examine spots around line images, the 8-point A-letters of the image in the running test were observed with a microscope to carry out evaluation according to the following criteria.

A: Almost no spots around line images appeared, and very good images were formed.

B: Although spots around line images somewhat appeared, good images were formed.

C: Images formed were on the level of no problem in practical use.

D: Spots around line images appeared, and images formed were undesirable in practical use.

Examples 2 to 12

Using Magnetic Toners 2 to 7, 11 and 14 to 17, image reproduction tests were conducted in the same manner as in Example 1. As a result, before and after running (extensive operation), all the toners afforded images on the level of no problem in practical use or higher.

The evaluation results in the high-temperature and high-humidity environment are shown in Table 3, and the results of evaluation in the low-temperature and low-humidity environment and the toner consumption in the normal-temperature and normal-humidity environment are shown in Table 4.

Comparative Examples 1 to 5

Using Magnetic Toners 8 to 10, 12 and 13, image reproduction tests were conducted in the same manner as those on Magnetic Toner 1. As a result, Magnetic Toners 8 and 13 deteriorated due to magnetic cohesion to cause density decrease and serious spots around line images in the high-temperature and high-humidity environment. Further, the toner consumption was 45 mg/page or more, showing large toner consumption.

Toners 9, 10 and 12 did not caused any serious problems in the high-temperature and high-humidity environment, but caused fog seriously in the low-temperature and low-humidity environment.

The evaluation results in the high-temperature and high-humidity environment are shown in Table 3, and the evaluation results in the low-temperature and low-humidity environment and the toner consumption in the normal-temperature and normal-humidity environment are shown in Table 4.

TABLE 3

Test Results in High-Temperature and High-Humidity Environment

| | | Initial stage | | | After 4,000 = sheet running | | |
|---|---|---|---|---|---|---|---|
| | Toner | Image density | Fog | Spots around line images | Image density | Fog | Spots around line images |
| Example: | | | | | | | |
| 1 | 1 | 1.52 | A | A | 1.51 | A | A |
| 2 | 2 | 1.43 | B | B | 1.38 | B | C |
| 3 | 3 | 1.47 | A | A | 1.42 | B | B |
| 4 | 4 | 1.44 | A | B | 1.38 | B | B |
| 5 | 5 | 1.46 | A | B | 1.42 | B | B |
| 6 | 6 | 1.42 | B | C | 1.38 | B | C |
| 7 | 7 | 1.51 | A | A | 1.42 | B | B |
| 8 | 11 | 1.47 | A | A | 1.43 | B | B |
| 9 | 14 | 1.41 | B | B | 1.37 | B | B |
| 10 | 15 | 1.54 | B | B | 1.50 | B | B |
| 11 | 16 | 1.51 | A | A | 1.49 | A | A |
| 12 | 17 | 1.40 | B | C | 1.34 | C | C |
| Comparative Example: | | | | | | | |
| 1 | 8 | 1.52 | A | A | 1.23 | B | C |
| 2 | 9 | 1.51 | B | B | 1.49 | B | B |
| 3 | 10 | 1.52 | B | B | 1.50 | B | B |
| 4 | 12 | 1.44 | A | B | 1.37 | B | C |
| 5 | 13 | 1.54 | A | A | 1.21 | B | D |

TABLE 4

Test Results in Low-Temperature and Low-Humidity Environment & Toner Consumption in Normal-Temperature and Normal-Humidity Environment

| | | Initial stage | | | After 4,000 = sheet running | | | Toner |
|---|---|---|---|---|---|---|---|---|
| | Toner | Image density | Fog | (1) | Image density | Fog | (1) | consumption (mg/page) |
| Example: | | | | | | | | |
| 1 | 1 | 1.48 | A | A | 1.46 | A | A | 33.4 |
| 2 | 2 | 1.40 | B | B | 1.35 | C | C | 38.1 |
| 3 | 3 | 1.45 | A | A | 1.42 | B | B | 34.8 |
| 4 | 4 | 1.42 | B | B | 1.40 | B | B | 36.5 |
| 5 | 5 | 1.44 | B | B | 1.40 | C | B | 37.2 |
| 6 | 6 | 1.40 | C | C | 1.35 | C | C | 38.9 |
| 7 | 7 | 1.47 | A | A | 1.45 | B | A | 38.5 |
| 8 | 11 | 1.42 | B | A | 1.38 | C | B | 34.6 |
| 9 | 14 | 1.41 | B | B | 1.37 | B | B | 36.2 |
| 10 | 15 | 1.47 | B | B | 1.41 | C | B | 34.9 |
| 11 | 16 | 1.47 | B | B | 1.40 | C | B | 34.1 |
| 12 | 17 | 1.45 | B | B | 1.41 | B | C | 38.2 |

TABLE 4-continued

Test Results in Low-Temperature and Low-Humidity Environment & Toner Consumption in Normal-Temperature and Normal-Humidity Environment

| | | Initial stage | | | After 4,000 = sheet running | | | Toner |
|---|---|---|---|---|---|---|---|---|
| | Toner | Image density | Fog | (1) | Image density | Fog | (1) | consumption (mg/page) |
| Comparative Example: | | | | | | | | |
| 1 | 8 | 1.47 | A | A | 1.42 | B | B | 43.5 |
| 2 | 9 | 1.47 | C | B | 1.36 | D | C | 37.5 |
| 3 | 10 | 1.46 | C | B | 1.35 | D | C | 36.9 |
| 4 | 12 | 1.40 | C | C | 1.34 | D | C | 33.1 |
| 5 | 13 | 1.49 | A | A | 1.32 | C | C | 50.9 |

(1): Spots around line images

This application claims priority from Japanese Patent Application No. 2005-042213 filed Feb. 18, 2005, which is hereby incorporated by reference herein.

What is claimed is:

1. A process for producing a magnetic toner having magnetic toner particles, comprising:

dispersing a hydrophobic magnetic powder, paraffin wax and a polymer having a sulfonic acid group into polymerizable monomers containing styrene and n-butyl acrylate, to obtain a polymerizable monomer composition, wherein said polymer having a sulfonic acid group is a terpolymer of styrene, n-butyl acrylate and 2-acrylamido-2-methylpropanesulfonic acid;

dispersing said polymerizable monomer composition into an aqueous medium containing a tricalcium phosphate dispersion stabilizer prepared in situ from $Na_3PO_4$ and $CaCl_2$ by means of a stirrer, to obtain particles of said polymerizable monomer composition;

polymerizing said polymerizable monomer in said particles of said polymerizable monomer composition; and washing said magnetic toner particles with ion-exchanged water, to obtain said magnetic toner particles having from 5 to 1,000 ppm of elemental calcium on the surfaces of the magnetic toner particles based on the weight of the magnetic toner particles, wherein:

said hydrophobic magnetic powder contains a phosphorus element in an amount from 0.05% by weight to 0.25% by weight based on an iron element and a silicon element in an amount from 0.30% by weight to 0.80% by weight based on the iron element, where a ratio of the phosphorous element to the silicon element (P/Si) is from 0.15 to 0.50;

said hydrophobic magnetic powder has a volume-average particle diameter (Dv) from 0.15 μm to 0.35 μm;

said hydrophobic magnetic powder has a saturation magnetization from 68.0 $Am^2/kg$ (emu/g) to 75.0 $Am^2/kg$ (emu/g);

said hydrophobic magnetic powder has a residual magnetization of 4.5 $Am^2/kg$ (emu/g) or less, in a magnetic field of 79.6 kA/m (1,000 oersted);

said hydrophobic magnetic powder has a 50% volume diameter from 0.5 μm to 1.1 μm in a mixture of 29.6 g of styrene and 10.4 g of n-butyl acrylate;

said hydrophobic magnetic powder has an SD value of 0.4 μm or less in a mixture of 29.6 g of styrene and 10.4 g of n-butyl acrylate, which is represented by the following formula (1):

$$SD=(d84\%-d16\%)/2 \quad (1),$$

wherein d16% represents a particle diameter at which a cumulative value is 16% by volume in volume-based particle size distribution, and d84% represents a particle diameter at which a cumulative value is 84% by volume;

said hydrophobic magnetic powder has been produced by introducing a magnetic powder into an aqueous medium, stirring and circulating a slurry of said magnetic powder and said aqueous medium by means of a pin mill, and introducing 1.5 to 3.1 parts by weight of a silane compound based on 100 parts by weight of said magnetic powder into said slurry while stifling and circulating said slurry by means of said pin mill, where hydrophobic treatment is conducted;

said magnetic toner particles contain said polymer having a sulfonic acid group; and said magnetic toner particles retain at surfaces thereof carbon elements in an amount of A (atomic %) and sulfur elements in an amount of E (atomic %) as measured by X-ray photoelectric spectrophotometry, wherein a ratio E/A satisfies:

$$3\times10^{-4}\leqq E/A\leqq 50\times10^{-4}.$$

* * * * *